US011229336B2

(12) United States Patent
Li et al.

(10) Patent No.: US 11,229,336 B2
(45) Date of Patent: Jan. 25, 2022

(54) HANDHELD VACUUM CLEANER

(71) Applicant: JIANGSU MIDEA CLEANING APPLIANCES CO., LTD., Suzhou (CN)

(72) Inventors: Guanhua Li, Suzhou (CN); Zhicheng Wang, Suzhou (CN); Songsong Qin, Suzhou (CN); Dongliang Lu, Suzhou (CN)

( * ) Notice: Subject to any disclaimer, the term of this patent is extended or adjusted under 35 U.S.C. 154(b) by 81 days.

(21) Appl. No.: 16/487,843

(22) PCT Filed: Mar. 30, 2017

(86) PCT No.: PCT/CN2017/078877

§ 371 (c)(1),
(2) Date: Aug. 22, 2019

(87) PCT Pub. No.: WO2018/152926

PCT Pub. Date: Aug. 30, 2018

(65) Prior Publication Data

US 2020/0037834 A1 Feb. 6, 2020

(30) Foreign Application Priority Data

Feb. 24, 2017 (CN) ..... 201710104129.0
Feb. 24, 2017 (CN) ..... 201710104474.4
(Continued)

(51) Int. Cl.
*A47L 5/24* (2006.01)
*A47L 9/16* (2006.01)
*A47L 9/32* (2006.01)

(52) U.S. Cl.
CPC ..... *A47L 5/24* (2013.01); *A47L 9/1691* (2013.01); *A47L 9/322* (2013.01)

(58) Field of Classification Search
CPC . A47L 7/0038; A47L 7/24; A47L 9/19; A47L 9/1691; A47L 9/322
(Continued)

(56) References Cited

U.S. PATENT DOCUMENTS 5,062,870 A 11/1991 Dyson
8,347,455 B2 * 1/2013 Dyson ..... A47L 9/2857 15/353
(Continued)

FOREIGN PATENT DOCUMENTS

CN 101489453 A 7/2009
CN 201586459 U 9/2010
(Continued)

OTHER PUBLICATIONS

OA for EP application 17898165.0.
(Continued)

*Primary Examiner* — Shay Karls
*Assistant Examiner* — Sarah Akyaa Fordjour
(74) *Attorney, Agent, or Firm* — Kilpatrick Townsend & Stockton, LLP

(57) ABSTRACT

A handheld vacuum cleaner includes a dust cup assembly, a suction nozzle assembly and a handle assembly. The dust cup assembly includes a cup casing, an airflow generation device and a cyclone separation device, both of which are arranged in the cup casing, the airflow generation device being arranged above the cyclone separation device and positioned on a downstream side of the cyclone separation device, and an air vent being formed in a top of the cup casing. The suction nozzle assembly is mounted to the cup casing and defines a suction channel. The handle assembly is mounted to the cup casing and used to be held. With the structure, a blowing direction of the air vent is not towards a surface to be cleaned, so as to prevent the wind from the
(Continued)

air vent blows away dust on the surface to be cleaned and hence ensure a cleaning effect.

16 Claims, 23 Drawing Sheets

(30) Foreign Application Priority Data

| | | |
|---|---|---|
| Feb. 24, 2017 | (CN) | 201720174403.7 |
| Feb. 24, 2017 | (CN) | 201720174404.1 |
| Feb. 24, 2017 | (CN) | 201720174405.6 |
| Feb. 24, 2017 | (CN) | 201720174461.X |
| Feb. 24, 2017 | (CN) | 201720174462.4 |
| Feb. 24, 2017 | (CN) | 201720174464.3 |
| Feb. 24, 2017 | (CN) | 201720174465.8 |
| Feb. 24, 2017 | (CN) | 201720174665.3 |
| Feb. 24, 2017 | (CN) | 201720174707.3 |
| Feb. 24, 2017 | (CN) | 201720174709.2 |
| Feb. 24, 2017 | (CN) | 201720174754.8 |
| Feb. 24, 2017 | (CN) | 201720174755.2 |
| Feb. 24, 2017 | (CN) | 201720174822.0 |
| Feb. 24, 2017 | (CN) | 201720174824.X |
| Feb. 24, 2017 | (CN) | 201720174851.7 |
| Feb. 24, 2017 | (CN) | 201720174853.6 |
| Feb. 24, 2017 | (CN) | 201720174890.7 |
| Feb. 24, 2017 | (CN) | 201720180418.4 |

(58) Field of Classification Search
USPC ..... 15/344, 300.1
See application file for complete search history.

(56) References Cited

U.S. PATENT DOCUMENTS

| | | | | |
|---|---|---|---|---|
| 2007/0113371 | A1 | 5/2007 | Cho | |
| 2017/0196419 | A1* | 7/2017 | Brown | A47L 9/1608 |
| 2017/0280952 | A1* | 10/2017 | Nam | A47L 9/1608 |
| 2018/0132683 | A1* | 5/2018 | Walker | A47L 9/0036 |

FOREIGN PATENT DOCUMENTS

| | | | |
|---|---|---|---|
| CN | 102525350 | A | 7/2012 |
| CN | 103040412 | A | 4/2013 |
| CN | 103784081 | A | 5/2014 |
| CN | 203802387 | U | 9/2014 |
| CN | 204016180 | U | 12/2014 |
| CN | 204581152 | U | 8/2015 |
| CN | 105640426 | A | 6/2016 |
| CN | 105942925 | A | 9/2016 |
| CN | 205671986 | U | 11/2016 |
| CN | 205671987 | U | 11/2016 |
| CN | 106343919 | A | 1/2017 |
| CN | 106377204 | A | 2/2017 |
| CN | 106388707 | A | 2/2017 |
| CN | 206934036 | U | 1/2018 |
| GB | 2440107 | A | 1/2008 |
| GB | 2440108 | A | 1/2008 |
| JP | H07250788 | A | 10/1995 |
| JP | 2015163224 | A | 9/2015 |
| JP | 2015208577 | A | 11/2015 |
| WO | 2014119192 | A1 | 8/2014 |
| WO | 2014141780 | A1 | 9/2014 |

OTHER PUBLICATIONS

OA for CN application 201710104474.4.
English translation of OA for CN application 201710104474.4.
ISR for PCT application PCT/CN2017/078882.
English translation of ISR for PCT application PCT/CN/2017078882.
ISR for PCT application PCT/CN2017/078877.
English translation of ISR for PCT application PCT/CN2017/078877.
ISR for PCT application PCT/CN2017/078881.
English translation of ISR for PCT application PCT/CN2017/078881.

* cited by examiner

HANDHELD VACUUM CLEANER

PRIORITY CLAIM AND RELATED APPLICATION

The present disclosure is a national phase application of International Application No. PCT/CN2017/078877, filed on Mar. 30, 2017, which claims the priorities of Chinese Applications No. 201720174851.7, 201720174754.8, 201720174464.3, 201710104474.4, 201720174665.3, 201720174404.1, 201720174890.7, 201720180418.4, 201720174405.6, 201720174461.X, 201710104129.0, 201720174709.2, 201720174822.0, 201720174853.6, 201720174462.4, 201720174465.8, 201720174824.X, 201720174755.2, 201720174707.3 and 201720174403.7, filed in the Chinese Patent Office on Feb. 24, 2017, the entireties of which are herein incorporated by reference.

FIELD

The present disclosure relates to a field of vacuum cleaners, particularly to a handheld vacuum cleaner.

BACKGROUND

In a handheld vacuum cleaner in the related art, an air vent is usually arranged in a top of a handle or in a bottom of a dust cup. When the air vent is arranged in the top of the handle, air blown out by the air vent is easily blown to a user, causing discomfort to the user, and when the air vent is arranged in the bottom of the dust cup, the air blown out by the air vent is easily blown to a surface to be cleaned, causing a dust raising problem.

SUMMARY

The present disclosure seeks to solve at least one of the problems existing in the related art to at least some extent. Accordingly, the present disclosure provides a handheld vacuum cleaner which has a good exhaust effect.

The handheld vacuum cleaner according to embodiments of the present disclosure includes a dust cup assembly, wherein the dust cup assembly includes a cup casing arranged vertically, an airflow generation device and a cyclone separation device, both of which are arranged in the cup casing, the airflow generation device is arranged above the cyclone separation device and located at a downstream side of the cyclone separation device, and an air vent is formed in a top of the cup casing; a suction nozzle assembly mounted to the cup casing and defining a suction channel; and a handle assembly mounted to the cup casing and used to be held.

In the handheld vacuum cleaner according to the present disclosure, by arranging the air vent at the top of the cup casing, an exhaust distance can be effectively shortened, the energy consumption can be reduced, and a problem that the air vent blows air to a user or a surface to be cleaned can be effectively avoided.

According to some embodiments of the present disclosure, the suction nozzle assembly is transversely mounted to the cup casing, and projected onto a vertical plane, a blowing direction of the air vent is inclined upward relative to an axial direction of the suction channel.

According to some embodiments of the present disclosure, an included angle $\theta$ between the axial direction of the suction channel and the blowing direction of the air vent is projected onto a horizontal plane and satisfies: $20° \leq \theta \leq 120°$.

According to some embodiments of the present disclosure, an inner side of the air vent is provided with an air guide surface to adjust the blowing direction thereof, and an included angle $\alpha$ between an extension line of the air guide surface and a connection line between a central point of the air vent and a central point of a dust cup is projected onto the horizontal plane and satisfies: $10° \leq \alpha \leq 90°$.

According to some embodiments of the present disclosure, projected onto the horizontal plane, a width D between a front side wall of the air vent and a rear side wall of the air vent is larger than a width d between a rear side wall of an outer edge of the air guide surface and the rear side wall of the air vent, wherein the width d satisfies: $2\ mm \leq d \leq 6\ mm$.

According to some embodiments of the present disclosure, a plurality of air vents are provided and are all formed into an elongated shape extending along an up-down direction, and projected onto the horizontal plane, and the plurality of the air vents are symmetrically distributed about an axis of the suction channel.

According to some embodiments of the present disclosure, the airflow generation device includes a motor and a fan wheel connected with a rotating shaft of the motor, the cup casing is cylindrical and has a central axis parallel to but not coincident with a rotation axis of the motor, and the axis of the suction channel intersects with and is perpendicular to the central axis of the cup casing.

According to some embodiments of the present disclosure, the airflow generation device includes the motor and the fan wheel connected with the rotating shaft of the motor, and the axis of the suction channel intersects with the rotation axis of the motor at an acute angle or an obtuse angle.

According to some embodiments of the present disclosure, an acute angle $\gamma$ at which the axis of the suction channel intersects with the rotation axis of the motor satisfies: $20° \leq \gamma \leq 70°$.

According to some embodiments of the present disclosure, the airflow generation device includes the motor and the fan wheel connected with the rotating shaft of the motor, and the axis of the suction channel is parallel to or coincident with the rotation axis of the motor.

According to some embodiments of the present disclosure, the airflow generation device includes a negative pressure unit and a hood arranged outside and covering the negative pressure unit, the axis of the suction channel extends along a horizontal direction and is below a top end of the negative pressure unit, and a vertical distance L between the axis of the suction channel and the top end of the negative pressure unit satisfies $0.2\ H \leq L \leq 1.2\ H$, wherein H is a height of the negative pressure unit in a vertical direction.

According to some embodiments of the present disclosure, the axis of the suction channel extends along the horizontal direction and is below a top end of the cup casing, and a vertical distance L between the axis of the suction channel and the top end of the cup casing satisfies $0.2\ S \leq L \leq 0.8\ S$, wherein S is a height of the cup casing in the vertical direction.

According to some embodiments of the present disclosure, an upstream filter is provided between the airflow generation device and the cyclone separation device, and a downstream filter is provided on a downstream side of the airflow generation device.

According to some embodiments of the present disclosure, the air vent is arranged opposite to the downstream filter.

According to some embodiments of the present disclosure, the airflow generation device includes the negative pressure unit and the hood arranged outside and covering the negative pressure unit, the hood is provided with a plurality of exhaust holes, the downstream filter is annular and sleeved over the hood to surround the exhaust holes, and the air vent is arranged around the downstream filter.

According to some embodiments of the present disclosure, the cyclone separation device includes a primary cyclone separator, a secondary cyclone separator arranged in the primary cyclone separator, and a filter cartridge arranged in the secondary cyclone separator, wherein an air flow enters between the cup casing and the primary cyclone separator tangentially through the suction channel to undergo first cyclone separation, then enters between the secondary cyclone separator and the filter cartridge through the primary cyclone separator and the secondary cyclone separator to undergo second cyclone separation, then flows to the airflow generation device through the filter cartridge and the upstream filter, and finally is discharged out of the cup casing through the downstream filter and the air vent.

According to some embodiments of the present disclosure, the handle assembly includes a handle to be assembled with the cup casing and a power supply connected with the handle and used to supply power to the airflow generation device, wherein the handheld vacuum cleaner is internally provided with a heat dissipation air duct configured to guide an airflow in the cup casing to the power supply.

According to some embodiments of the present disclosure, a dust retaining rib is provided to an inner wall surface of the cup casing.

DETAILED DESCRIPTION

Figure 1:
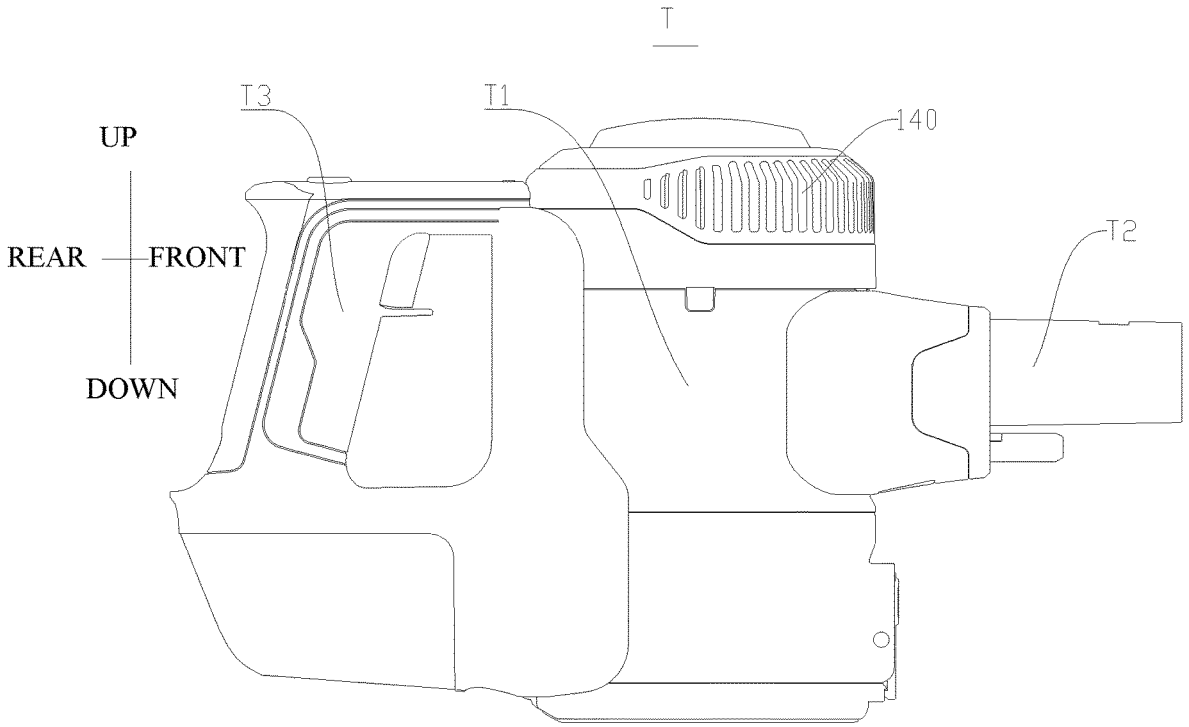
FIG. 1 is a front view illustrating a handheld vacuum cleaner according to an embodiment of the present disclosure.

Embodiments of the present disclosure are further described below in detail, and examples of the embodiments are shown in accompanying drawings, wherein the same or similar elements and the elements having same or similar functions are denoted by like reference numerals throughout the descriptions. The embodiments described below with reference to the accompanying drawings are exemplary, are merely used to explain the present disclosure, and cannot be construed as limitation on the present disclosure.

Various embodiments and examples are provided in the following description to implement different structures of the present disclosure. In order to simplify the present disclosure, certain elements and settings of specific examples will be described below, but they are exemplary and are not intended to limit the present disclosure. In addition, reference numerals may be repeated in different examples in the present disclosure. This repetition is for the purpose of simplification and clarity and does not refer to relations between different embodiments and/or settings. Furthermore, examples of different processes and materials are provided in the present disclosure.

Referring to FIGS. 1 to 29, a handheld vacuum cleaner T according to embodiments of the present disclosure will be described below.

Referring to FIG. 1, the handheld vacuum cleaner T according to embodiments of the present disclosure includes a dust cup assembly T1, a suction nozzle assembly T2, and a handle assembly T3.

Referring to FIGS. 1-4, the dust cup assembly T1 includes a cup casing 1, as well as an airflow generation device 2 and a cyclone separation device 3 both provided in the cup casing 1; the suction nozzle assembly T2 is mounted to the cup casing 1 and defines a suction channel S1; and the handle assembly T3 is mounted to the cup casing 1 and is used to be held.

Figure 22:
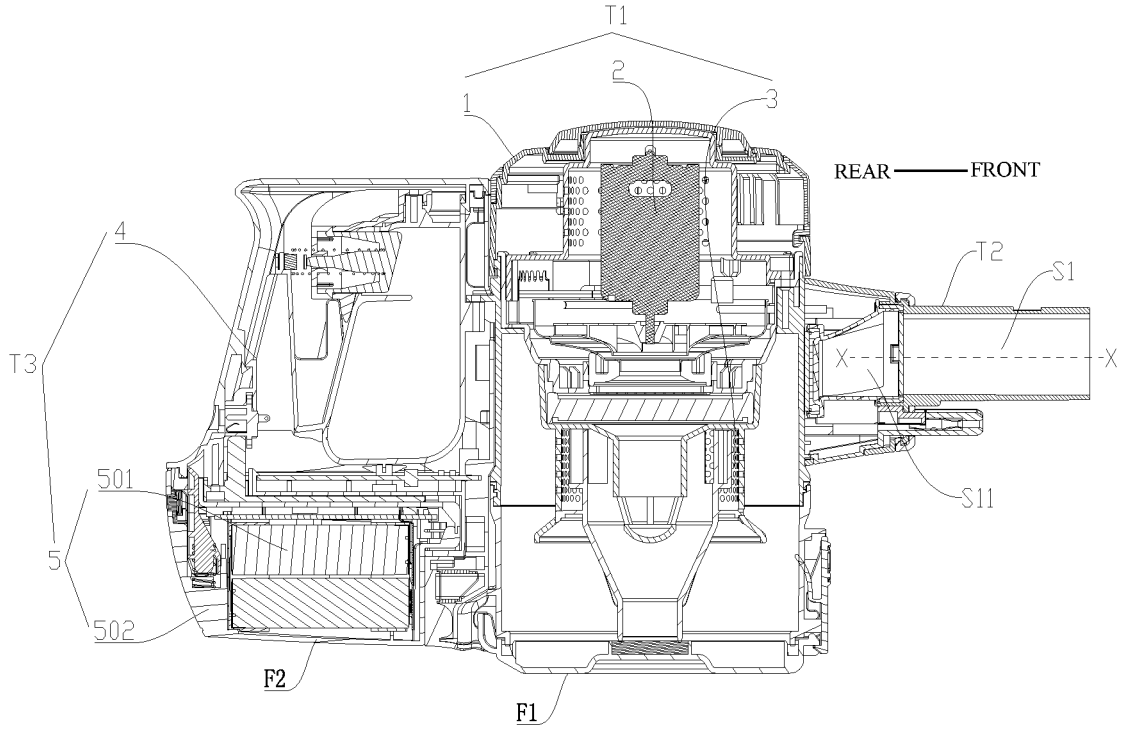
FIG. 22 is a front sectional view illustrating a handheld vacuum cleaner according to an embodiment of the present disclosure.

In combination with FIG. 22, one end (e.g., a rear end in FIG. 22) of the suction channel S1 is communicated with the cup casing 1, and the other end (e.g., a front end in FIG. 22) of the suction channel S1 has a suction port through which garbage such as dust and the like can enter the cup casing 1. In one embodiment, the suction nozzle assembly T2 is provided with a guide tube S11 therein, and the guide tube S11 is configured to enable an airflow to enter the cup casing 1 tangentially through the suction channel S1, such that the airflow generates a centrifugal force, thereby facilitating separation of impurities such as dust and the like in the airflow and improving a cleaning effect.

Therefore, when the handheld vacuum cleaner T is in use, a user can lift the handheld vacuum cleaner T by holding the handle assembly T3, make the suction channel S1 face a place to be cleaned, and then can start the airflow generation device 2. When the airflow generation device 2 is started, negative pressure can be generated inside the cup casing 1. At this time, dusty air outside the cup casing 1 can be sucked into the cup casing 1 through the suction channel S1, so as to be separated by the cyclone separation device 3. The separated dust can remain in the cup casing 1, and the separated clean air can be discharged out of the cup casing 1, thereby realizing the dust absorption and cleaning operation of the handheld vacuum cleaner T.

Here, it should be noted that the airflow generation device 2 refers to an assembly that includes a driving component (such as a motor 211 described below) and a power component (such as a fan wheel 212 described below) and hence is able to generate negative pressure. In addition, the cyclone separation principle of the cyclone separation device 3 may be used. Moreover, the dust cup assembly T1 according to embodiments of the present disclosure can also be used in other types of vacuum cleaners besides the handheld vacuum cleaner T, such as a push-type vacuum cleaner and the like, if the actual situation allows.

Figure 4:
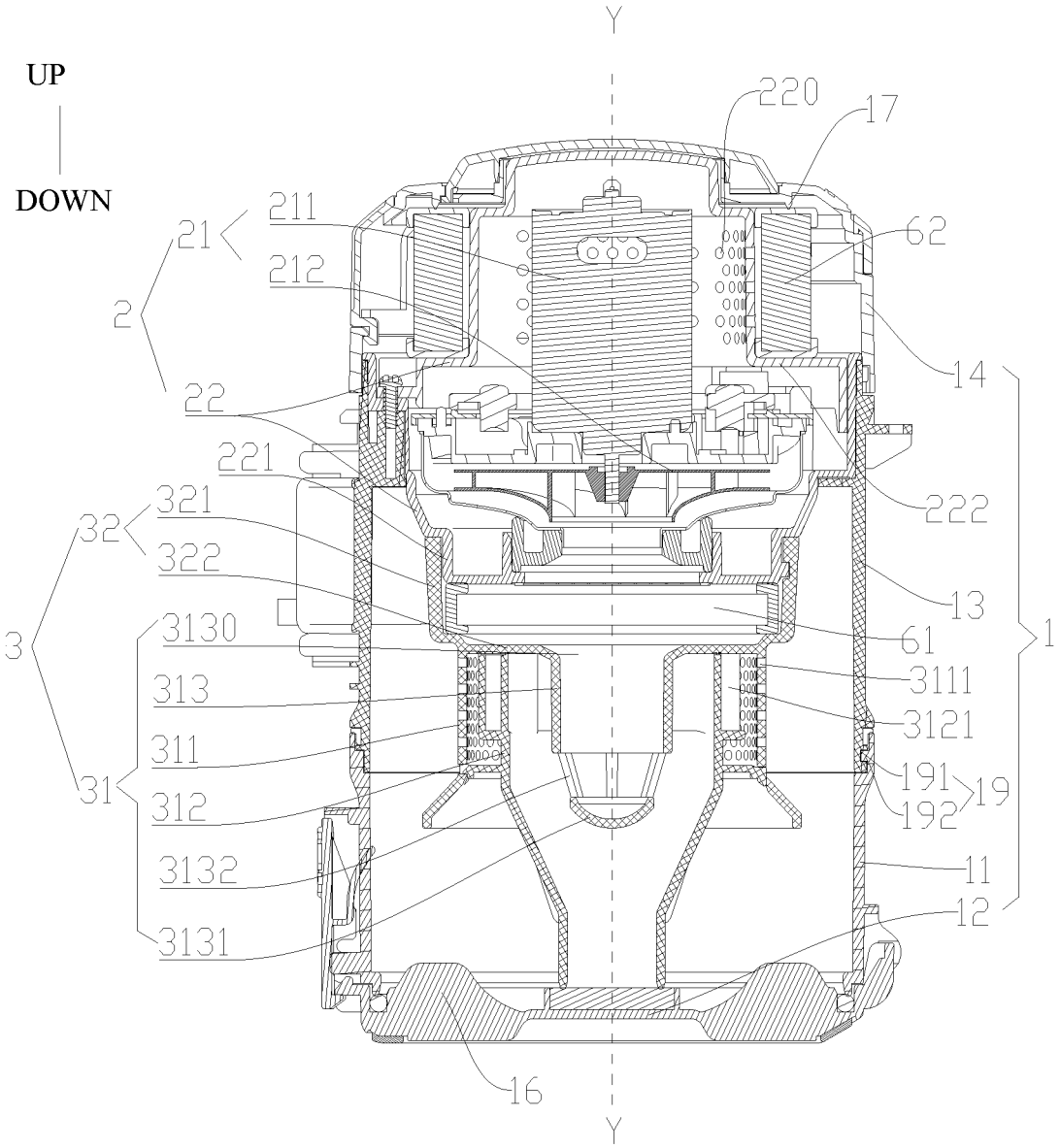
FIG. 4 is a sectional view illustrating the handheld vacuum cleaner shown in FIG. 1.

Referring to FIG. 4, the handheld vacuum cleaner T according to some embodiments of the present disclosure is characterized in that an upstream filter 61 is provided on an upstream side of the airflow generation device 2, so that the airflow can be filtered and dedusted by the upstream filter 61 before flowing into the airflow generation device 2; and a downstream filter 62 is provided on a downstream side of the airflow generation device 2, so that the airflow can be filtered and dedusted by the downstream filter 62 after flowing out of the airflow generation device 2.

Here, it should be noted that "downstream" in the present application refers to the downstream in an air flow direction, and accordingly, "upstream" in the present application refers to the upstream in the air flow direction.

In some specific examples of the present disclosure, referring to FIG. 4, the cyclone separation device 3 can be disposed on the upstream side of the airflow generation device 2, that is, dusty air is separated by the cyclone separation device 3 in advance and then flows to the airflow generation device 2. At this time, the upstream filter 61 can be disposed downstream (i.e., disposed between the cyclone separation device 3 and the airflow generation device 2) or upstream (not shown in the drawings) of the cyclone separation device 3. When the upstream filter 61 is disposed downstream of the cyclone separation device 3, the clean air separated by the cyclone separation device 3 can be filtered again by the upstream filter 61 and then flows to the airflow generation device 2, thereby not only improving the cleaning effect, but also effectively protecting the airflow generation device 2. When the upstream filter 61 is disposed upstream of the cyclone separation device 3, dusty air that has not yet flowed into the cyclone separation device 3 can be pre-filtered by the upstream filter 61, thereby not only improving the cleaning effect, but also effectively protecting the cyclone separation device 3. In addition, since the downstream filter 62 is disposed downstream of the airflow generation device 2, the air flowing out of the airflow generation device 2 can be filtered again by the downstream filter 62 and then flows out of the cup casing 1, thereby effectively preventing secondary pollution and improving the cleaning effect.

In other specific examples of the present disclosure, the cyclone separation device 3 can also be disposed on the downstream side of the airflow generation device 2 (not shown in the drawings), that is, dusty air passes through the airflow generation device 2 first and then flows to the cyclone separation device 3 to be separated. At this time, the downstream filter 62 can be disposed upstream (i.e., disposed between the cyclone separation device 3 and the airflow generation device 2) or downstream of the cyclone separation device 3. When the downstream filter 62 is disposed upstream of the cyclone separation device 3, dusty air that has not yet flowed into the cyclone separation device 3 can be pre-filtered by the downstream filter 62, thereby not only improving the cleaning effect, but also effectively protecting the cyclone separation device 3. When the downstream filter 62 is disposed downstream of the cyclone separation device 3, the clean air separated by the cyclone separation device 3 can be filtered again by the downstream filter 62 and then flows out of the cup casing 1, thereby effectively improving the cleaning effect. In addition, since the upstream filter 61 is disposed upstream of the airflow generation device 2, dusty air that has not yet flowed into the airflow generation device 2 can be pre-filtered by the upstream filter 61, thereby not only improving the cleaning effect, but also effectively protecting the airflow generation device 2.

Therefore, in the handheld vacuum cleaner T according to the above embodiments of the present disclosure, the upstream filter 61 is disposed upstream of the airflow generation device 2 while the downstream filter 62 is disposed downstream of the airflow generation device 2, thereby not only improving the overall cleaning effect of the handheld vacuum cleaner T, but also effectively protecting the airflow generation device 2 and the cyclone separation device 3.

Certainly, the present disclosure is not limited thereto. In other embodiments of the present disclosure, when the handheld vacuum cleaner T according to embodiments of the present disclosure has other features, the handheld vacuum cleaner T can include only the upstream filter 61, or include only the downstream filter 62, or include neither the upstream filter 61 nor the downstream filter 62.

The handheld vacuum cleaner T according to some specific embodiments of the present disclosure will be described below based on the structure and layout of the dust cup assembly T1.

First, the handheld vacuum cleaner T according to some specific embodiments of the present disclosure will be described based on the relative positions of the cup casing 1, the airflow generation device 2, the cyclone separation device 3, the downstream filter 62, and the upstream filter 61.

In some embodiments of the present disclosure, referring to FIG. 4, a central axis of the airflow generation device 2, a central axis of the downstream filter 62, and a central axis of the upstream filter 61 coincide. That is, the airflow generation device 2, the downstream filter 62, and the upstream filter 61 are coaxially disposed. Therefore, it is convenient to process and assemble, and the structure of the dust cup assembly T1 is more compact, small and regular, which meets a miniaturization requirement of the handheld vacuum cleaner T and is convenient for users to carry.

Here, it should be noted that the central axis of the airflow generation device 2 refers to a central axis of the driving component of the airflow generation device 2. For example, when the driving component is the motor 211, a central axis of the motor 211, i.e., a rotation axis of the motor 211, is the central axis of the airflow generation device 2. In addition, in the present embodiment, both the downstream filter 62 and the upstream filter 61 are formed in a shape having a straight central axis, such as a cylinder, an annular column, a prismatic shape, a flat column, and the like. For example, in some specific examples of the present disclosure, the downstream filter 62 can be formed in an annular cylinder and the upstream filter 61 can be formed in a flat cylinder, thereby facilitating processing and manufacturing. Optionally, the motor 211 may be a DC motor, a BLDC motor, or the like.

Further, referring to FIG. 4, the cup casing 1 can be formed into a cylindrical shape (the "cylindrical shape" here is understood broadly, i.e., not referring to a cylindrical shape in a strict sense, and for example, the shape of the cup casing 1 shown in FIG. 4 can also be understood as a cylindrical shape). At this time, a central axis Y-Y of the cup casing 1, the central axis of the airflow generation device 2, the central axis of the downstream filter 62, and the central axis of the upstream filter 61 coincide. That is, when the airflow generation device 2, the downstream filter 62, and the upstream filter 61 are coaxially disposed, the cup casing 1 is coaxially disposed outside and covers the three. Therefore, it is convenient to process and assemble, and the dust cup assembly T1 is more compact, small and regular in structure, adapting to the miniaturization requirement of the handheld vacuum cleaner T, such that the handheld vacuum cleaner is more convenient for users to carry, more stable in center of gravity and more beautiful in appearance.

In some embodiments of the present disclosure, referring to FIG. 4, the center of gravity of the airflow generation device 2 and the center of gravity of the cyclone separation device 3 are both located on the central axis Y-Y of the cup casing 1. Therefore, the center of gravity of the whole machine is more stable, the processing and assembly are more convenient, and the dust cup assembly T1 is more compact, small and regular in structure, adapting to the miniaturization requirement of the handheld vacuum cleaner T, such that the handheld vacuum cleaner is more convenient for users to carry and more beautiful in appearance. Here, it should be noted that the cup casing 1 is formed in a shape having a straight central axis, such as a cylindrical shape or the like.

In some embodiments of the present disclosure, referring to FIG. 4, the central axis of the airflow generation device 2 coincides with the central axis of the cyclone separation device 3. That is, the airflow generation device 2 and the cyclone separation device 3 are coaxially disposed. Therefore, it is convenient to process and assemble, and the dust cup assembly T1 is more compact, small and regular in structure, meeting the miniaturization requirement of the handheld vacuum cleaner T, such that the handheld vacuum cleaner is more convenient for users to carry, more stable in center of gravity and more beautiful in appearance. Here, it should be noted that the cyclone separation device 3 is formed in a shape having a straight central axis, such as the shape of the cyclone separation device 3 shown in FIG. 4.

Further, referring to FIG. 4, the cup casing 1 can be formed into a cylindrical shape (the "cylindrical shape" here is understood broadly, i.e., not referring to a cylindrical shape in a strict sense, and for example, the shape of the cup casing 1 shown in FIG. 4 can also be understood as a cylindrical shape). At this time, the central axis Y-Y of the cup casing 1, the central axis of the airflow generation device 2, the central axis of the airflow generation device 2, and the central axis of the cyclone separation device 3 coincide. That is, when the airflow generation device 2 and the cyclone separation device 3 are coaxially disposed, the cup casing 1 is coaxially disposed outside and covers the both. Therefore, the center of gravity of the whole machine is more stable, the processing and assembly are more convenient, and further, the dust cup assembly T1 is more compact, small and regular in structure, thereby further adapting to the miniaturization requirement of the handheld vacuum cleaner T, and allowing the handheld vacuum cleaner to be more convenient for users to carry and more beautiful in appearance.

The handheld vacuum cleaner T according to some specific embodiments of the present disclosure will be described based on the arrangement of the cup casing 1.

In some embodiments of the present disclosure, referring to FIG. 4, the cup casing 1 can include a lower case body 11, a cup bottom cover 12 and an upper case body 13. A top end and a bottom end of the lower case body 11 are both open, the upper case body 13 is provided at the top of the lower case body 11 and defines an accommodating cavity together with the lower case body 11, and the cup bottom cover 12 is provided at the bottom of the lower case body 11 to open and close the bottom end of the lower case body 11, that is, the cup bottom cover 12 is openably and closably provided at the bottom of the lower case body 11. Thus, when that cup bottom cover 12 is opened, dust deposit on the cup bottom cover 12 can be poured out. Here, it should be noted that in the context, the cup bottom cover 12 refers to a cover-shaped body whose height is much smaller than that of the lower case body 11.

In one embodiment, referring to FIG. 4, the upper case body 13 is detachably connected to the lower case body 11, that is, the upper case body 13 is detachably connected to the top of the lower case body 11, so that the user can remove the lower case body 11 from the upper case body 13 as needed. In this way, when the user wishes to pour out the dust inside the cup casing 1, the lower case body 11 can be detached from the upper case body 13 without opening the cup bottom cover 12, and the lower case body 11 can be inverted to achieve the same dust-pouring effect. Moreover, after the user detaches the lower case body 11 from the upper case body 13, the user can also clean the components mounted to the upper case body 13 (especially exposed components, i.e., components that are originally covered by the lower case body 11 and not easily accessible, such as a lower half of the cyclone separation device 3 shown in FIG. 4) and clean the lower case body 11, which makes it extremely convenient for the user to clean and improves the cleaning effect of the handheld vacuum cleaner T.

In one embodiment, referring to FIG. 4, a difference between a height of the upper case body 13 and a height of the lower case body 11 is 0 mm to 5 mm, that is, the height of the upper case body 13 is substantially equal to the height of the lower case body 11, such that when a cross-sectional area of the upper case body 13 is substantially equal to a cross-sectional area of the lower case body 11, the upper case body 13 has a volume substantially equal to a volume of the lower case body 11. At this time, both the upper case body 13 and the lower case body 11 can be used to contain components. For example, one half of a volume of a component to be provided in the cup casing 1 can be accommodated in the upper case body 13 and the other half of the volume thereof can be accommodated in the lower case body 11. For example, in an example shown in FIG. 4, when the airflow generation device 2 is located above the cyclone separation device 3 and on the downstream side of the cyclone separation device 3, more than a half of the cyclone separation device 3 in a height direction can be accommodated in the lower case body 11.

In this way, when the user removes the lower case body 11 from the upper case body 13, the components in the cup casing 1 (such as the cyclone separation device 3 which is not easy to clean) can be effectively cleaned, and stubborn dirt in the lower case body 11 can also be eliminated. Here, it could be understood that when the cup casing 1 is relatively high and a gap between the cup casing 1 and its internal components is relatively small, it is difficult for the user to extend a finger into the gap between the cup casing 1 and its internal components to clean the internal components or an inner wall of the cup casing 1 if the user only opens the cup bottom cover 12. However, for the cup casing 1 according to the embodiments of the present disclosure, the user can easily accomplish the cleaning operation because the cup casing 1 is processed into an upper part and a lower part detachable from each other.

In some embodiments of the present disclosure, referring to FIG. 4, an inner wall surface of the cup casing 1 is provided with a dust retaining rib 16. For example, the dust retaining rib 16 can be provided to an inner bottom wall and/or an inner side wall of the cup casing 1, so that when dusty air is subjected to cyclone separation inside the cup casing 1, the dust in the dusty air can be retained by the dust retaining rib 16, thereby improving the dust-air separation efficiency and effect, reducing the probability of dust being rolled up again by the airflow, and further improving the dust-air separation efficiency and effect.

In some embodiments of the present disclosure, referring to FIG. 4, when an upper end of the lower case body 11 and a lower end of the upper case body 13 are both cylindrical, the upper case body 13 and the lower case body 11 can be detachably connected by a rotating action, and for example, the upper case body 13 and the lower case body 11 can be connected by a rotary buckling structure or a rotary thread structure described below. At this time, when the user needs to remove the lower case body 11 from the upper case body 13, the lower case body 11 can be removed by rotating counterclockwise (or clockwise), so as to conveniently pour out dust inside the lower case body 11, or clear away stubborn dust in the lower case body 11, or clean components mounted to the upper case body 13, or clean an interior of the lower case body 11. Thus, it is convenient for the user to disassemble and assemble the upper case body 13 and the lower case body 11.

Figure 6:
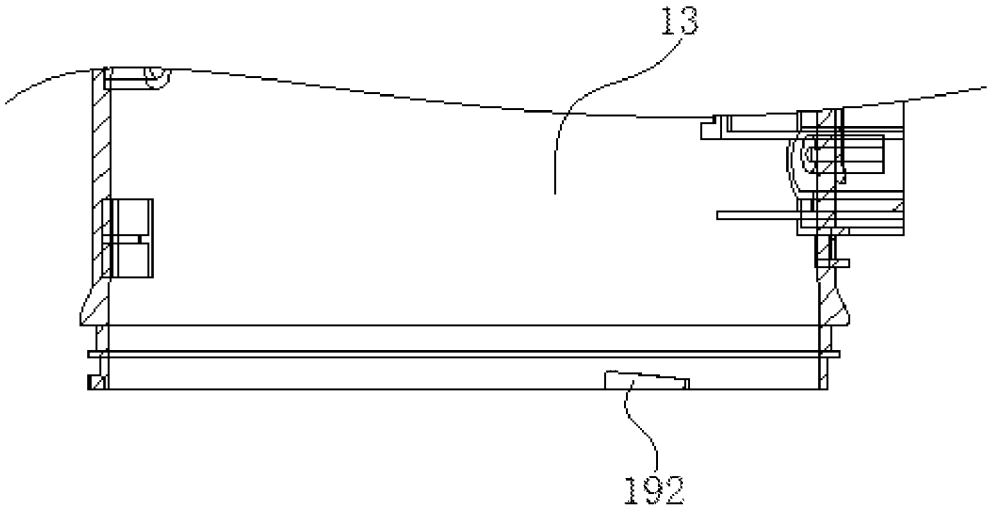
FIG. 6 is a partial schematic view illustrating an upper housing shown in FIG. 4.
Figure 7:
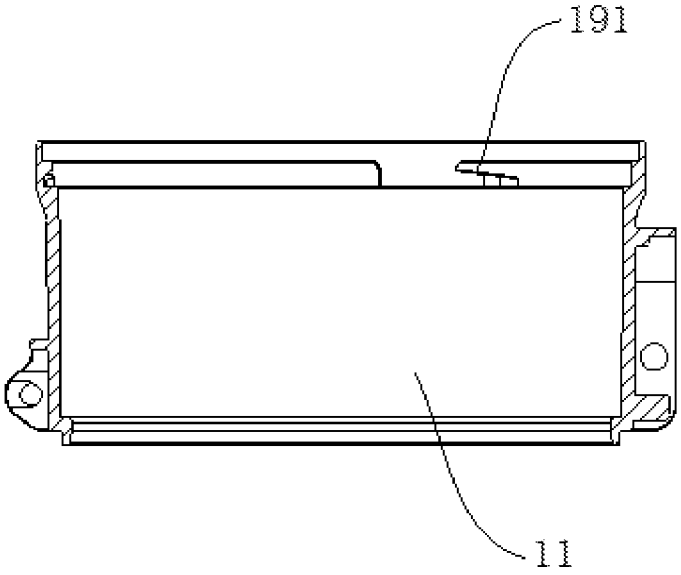
FIG. 7 is a schematic view illustrating a lower housing shown in FIG. 4.

In some embodiments of the present disclosure, referring to FIGS. 4, 6 and 7, the upper end of the lower case body 11 and the lower end of the upper case body 13 are both cylindrical, and the upper case body 13 and the lower case body 11 are detachably connected by a rotary buckling structure 19. The rotary buckling structure 19 includes a rotary insertion groove 191 and a rotary insertion strip 192. The rotary insertion groove 191 is formed in an inner peripheral surface of the upper end of the lower case body 11 (or in an inner peripheral surface of the lower end of the upper case body 13) and has an opening at one end. The rotary insertion strip 192 is formed on an outer peripheral surface of the lower end of the upper case body 13 (or an outer peripheral surface of the upper end of the lower case body 11) and exhibits a wedge shape. The rotary insertion strip 192 extends into the rotary insertion groove 191 through the opening and is fitted and locked with the other end of the rotary insertion groove 191 through rotary motion. Therefore, the rotary buckling structure is simple, and is convenient to process, assemble and disassemble. When the upper case body 13 and the lower case body 11 are mounted, the user only needs to vertically mount the rotary insertion strip into the rotary insertion groove from an open end of the rotary insertion groove, and then rotate the upper case body 13 or the lower case body 11, and when a clicking sound is heard, the lower case body 11 and the upper case body 13 are assembled in place and locked.

In some embodiments of the present disclosure, the upper end of the lower case body 11 and the lower end of the upper case body 13 are both cylindrical, and the upper case body 13 and the lower case body 11 are detachably connected by a rotary thread structure (not shown in the drawings). The rotary thread structure includes an internal thread and an external thread. For example, in a specific example of the present disclosure, the internal thread is formed on the inner peripheral surface of the upper end of the lower case body 11, and the external thread is formed on the outer peripheral surface of the lower end of the upper case body 13 and is threadedly fitted with the internal thread. For example, in another specific example of the present disclosure, the internal thread is formed on the inner peripheral surface of the lower end of the upper case body 13, and the external thread is formed on the outer peripheral surface of the upper end of the lower case body 11 and is threadedly fitted with the internal thread. Therefore, the rotary thread structure is simple, and is convenient to process, assemble and disassemble.

Certainly, the present disclosure is not limited thereto, and in other embodiments of the present disclosure, the detachable connection of the upper case body 13 and the lower case body 11 can be implemented in other manners. For example, the upper case body 13 and the lower case body 11 can also be detachably connected by a screw or a button hook structure described below (not shown in the drawings). At this time, it is not required that the upper end of the lower case body 11 and the lower end of the upper case body 13 are both cylindrical, so that the upper case body 13 and the lower case body 11 can be selected in an expanded range to better meet the actual needs.

For example, in some embodiments of the present disclosure, the upper case body 13 and the lower case body 11 can be detachably connected by the button hook structure. The button hook structure can include a first hook, a second hook, an elastic member and an unlocking member. The first hook is provided at the lower end of the upper case body 13, and the second hook is provided at the upper end of the lower case body 11. The elastic member is provided to the upper case body 13 and is used to push the first hook to be normally locked with the second hook, or is provided to the lower case body 11 and is used to push the second hook to be normally locked with the first hook. The unlocking member is provided to the upper case body 13 or the lower case body 11 and compresses the elastic member to unlock the first hook and the second hook when triggered.

In some embodiments of the present disclosure, referring to FIG. 4, the cup casing 1 can include a cup body and a cup top cover 14, the cup body has an open top, and the cup top cover 14 is provided at the top of the cup body to open and close the top of the cup body. Therefore, when the user needs to clean, replace, repair or perform other operations on the components inside the cup casing 1, the cup top cover 14 can be opened to facilitate operation.

Optionally, the cup top cover 14 and the cup body are rotatably separably connected by a rotary buckling structure or a rotary thread structure, so that the user only needs to rotate the cup top cover 14 and lift it upward to remove it from the cup body, thereby facilitating operation.

Figure 2:
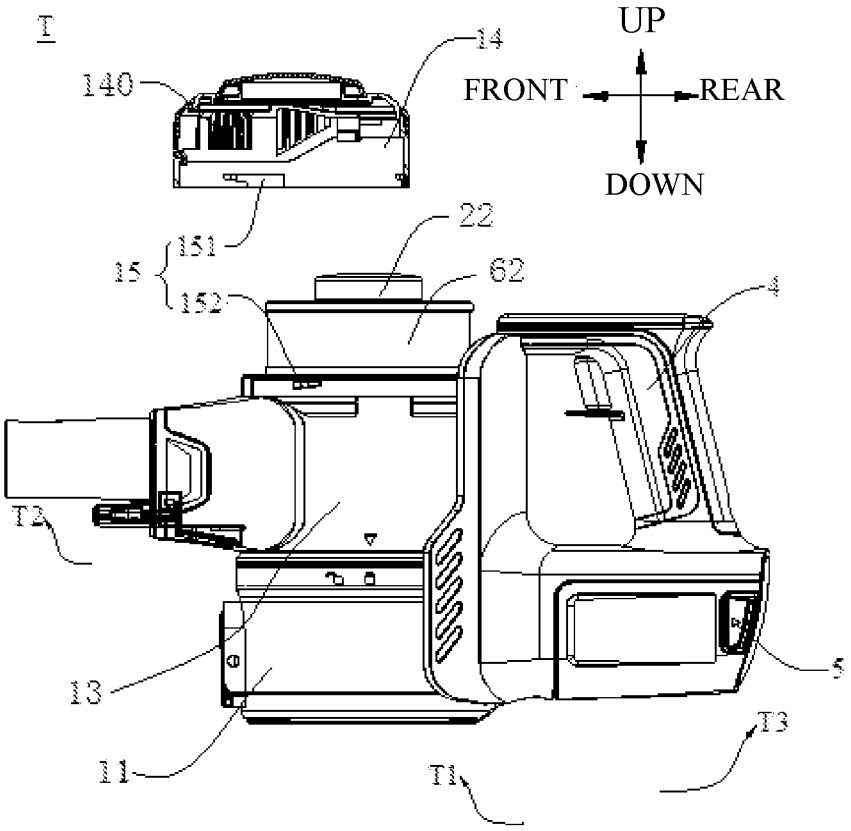
FIG. 2 is a partial exploded view illustrating the handheld vacuum cleaner shown in FIG. 1.
Figure 3:
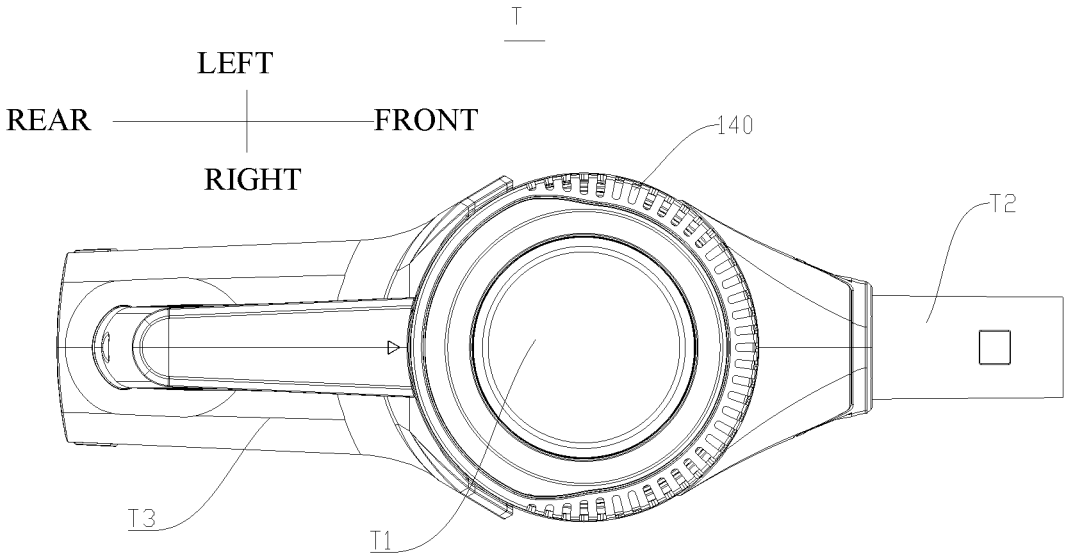
FIG. 3 is a top view illustrating the handheld vacuum cleaner shown in FIG. 1.

In some embodiments of the present disclosure, referring to FIGS. 2 and 4, an upper end of the cup body and a lower end of the cup top cover 14 are both cylindrical. The cup body and the cup top cover 14 are detachably connected through a rotary buckling structure 15. The rotary buckling structure 15 includes a rotary insertion groove 151 and a rotary insertion strip 152. For example, the rotary insertion groove 151 can be formed in an inner peripheral surface of the lower end of the cup top cover 14 and have an opening at one end; the rotary insertion strip 152 can be formed on an outer peripheral surface of the upper end of the cup body and be wedge-shaped; and the rotary insertion strip 152 extends into the rotary insertion groove 151 through the opening and is fitted and locked with the other end of the rotary insertion groove 151 through rotary motion. Therefore, the rotary buckling structure 15 has a simple structure and is convenient to process, assemble and disassemble. When mounting the cup top cover 14 and the cup body, the user only needs to vertically mount the rotary insertion strip 152 into the rotary insertion groove 151 from an open end of the rotary insertion groove 151, and then rotate the cup top cover 14 or the cup body. When a clicking sound is heard, the cup top cover 14 and the cup body are assembled in place and locked.

In some embodiments of the present disclosure (not shown in the drawings), the upper end of the cup body and the lower end of the cup top cover 14 are both cylindrical, and the cup top cover 14 and the cup body are detachably connected by a rotary thread structure (not shown in the drawings). The rotary thread structure includes an internal thread and an external thread. For example, in a specific example of the present disclosure, the internal thread is formed on an inner peripheral surface of the upper end of the cup body, and the external thread is formed on an outer peripheral surface of the lower end of the cup top cover 14 and is threadedly fitted with the internal thread. For example, in another specific example of the present disclosure, the internal thread is formed on the inner peripheral surface of the lower end of the cup top cover 14, and the external thread is formed on the outer peripheral surface of the upper end of the cup body and is threadedly fitted with the internal thread. Therefore, the rotary thread structure is simple and is convenient to process, assemble and disassemble.

Certainly, the present disclosure is not limited thereto. In other embodiments of the present disclosure, the detachable connection of the cup top cover 14 and the cup body can also be realized in other ways. For example, the cup top cover 14 and the cup body can also be detachably connected by a screw or the like. At this time, it is not required that the upper end of the cup body and the lower end of the cup top cover 14 are both cylindrical, so that the cup top cover 14 and the cup body can be selected in an expanded range to better meet the actual requirements. For another example, the cup top cover 14 can be openably but inseparably connected to the cup body through a button hook structure and a hinge structure, so that the user can unlock the button hook structure and lift the cup top cover 14 from the cup body, thereby facilitating operation. The structure and principle of the button hook structure will not be described in detail here.

In addition, it should be noted that the cup body can be a non-detachable single-piece cup body with an open top and a closed bottom. The cup body can also be a detachable multi-piece assembly composed of the lower case body 11, the upper case body 13 and the cup bottom cover 12 described above, in which case, the cup top cover 14 is provided at the top of the upper case body 13 to open and close the top end of the upper case body 13 (as shown in FIG. 4).

The handheld vacuum cleaner T according to some embodiments of the present disclosure will be described based on the arrangement of the downstream filter 62.

In some embodiments of the present disclosure, the top of the cup casing 1 can be opened, and for example, the cup top cover 14 described above can be removed from the top of the cup body or can be lifted upward. The airflow generation device 2 is disposed above the cyclone separation device 3. The downstream filter 62 is located at an upper part of or at a top of the airflow generation device 2 and detachably connected with the airflow generation device 2 or the cup casing 1, so as to be taken out upward from the top of the cup casing 1 when the top of the cup casing 1 is opened. Thus, when the user opens the top of the cup casing 1, the downstream filter 62 can be seen and removed from the cup casing 1 or the airflow generation device 2, and taken out for relevant operations, such as cleaning, replacement, maintenance, etc. For example, after the handheld vacuum cleaner T is used for a period of time, the top of the cup casing 1 can be opened, and then the downstream filter 62 can be detached from the cup casing 1 or the airflow generation device 2, so that the downstream filter 62 can be cleaned or replaced conveniently and in time to maintain a suction force of the handheld vacuum cleaner T and ensure the cleaning effect.

Therefore, for the handheld vacuum cleaner T according to the present embodiment, the downstream filter 62 can be directly taken out, which makes it convenient for the user to clear away dust on the downstream filter 62, keeps the downstream filter 62 clean, and helps to maintain the original dust absorption capacity and efficiency ratio of the handheld vacuum cleaner T.

In one embodiment, referring to FIG. 4, the airflow generation device 2 includes a negative pressure unit 21 and a hood 22 disposed outside and covering the negative pressure unit 21, and the hood 22 has a plurality of exhaust holes 220. For example, the negative pressure unit 21 can include a motor 211 and a fan wheel 212. The motor 211 can be connected to a top of the fan wheel 212 to drive the fan wheel 212 to rotate. The hood 22 can include an upper hood covering an upper part of the negative pressure unit 21 and a lower hood covering a lower part of the negative pressure unit 21. The upper hood is connected to a top of the lower hood and is formed with the exhaust holes 220, such that an airflow sucked into the hood 22 by the negative pressure unit 21 can be discharged to the outside of the hood 22.

Specifically, when the downstream filter 62 is detachably connected with the airflow generation device 2, in a specific example of the present disclosure, the downstream filter 62 can be configured to be annular and be sleeved over the hood 22 to surround the exhaust holes 220 (as shown in FIG. 4), so that the downstream filter 62 can effectively filter and clean the airflow discharged from the airflow generation device 2. Therefore, the downstream filter 62 has a simple structure and is convenient to process, and the user can remove the downstream filter 62 from the airflow generation device 2, and mount the cleaned or replaced downstream filter 62 to the airflow generation device 2 again conveniently, thereby facilitating the operations. Certainly, the present disclosure is not limited thereto, and the downstream filter 62 can be detachably provided in the cup casing 1 by other means, which will not be described here.

Figure 5:
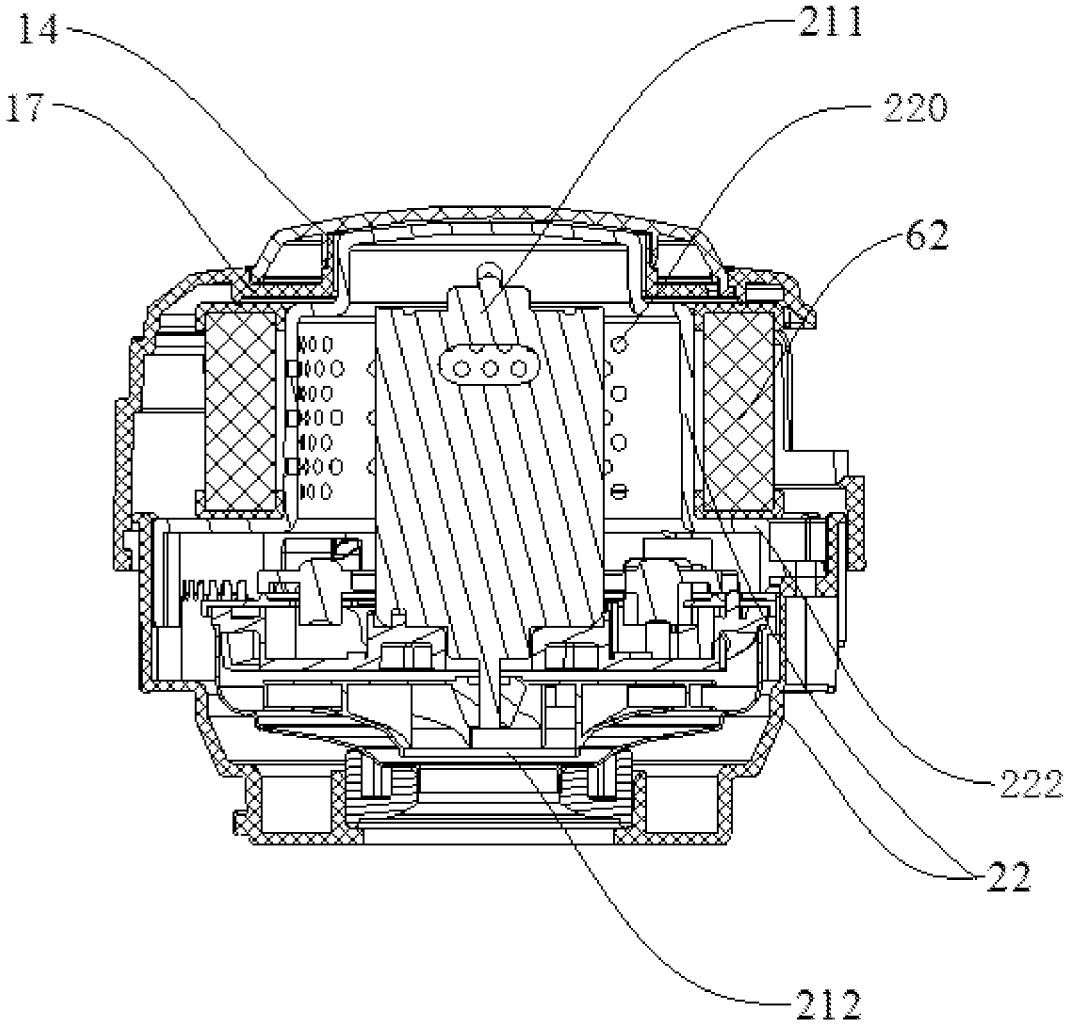
FIG. 5 is a schematic view illustrating an upper half of the handheld vacuum cleaner shown in FIG. 4.

Further, as shown in FIGS. 4 and 5, the cup casing 1 includes a pressing structure 17, the hood 22 includes a support platform 222, and both axial ends of the downstream filter 62 abut against between the pressing structure 17 and the support platform 222. Therefore, when the dust cup assembly T1 is assembled in place, the downstream filter 62 can be tightly sleeved over the hood 22 on the one hand, and can be tightly pressed by the pressing structure 17 and the support platform 222 on the other hand. For example, an upper end of the downstream filter 62 can abut against a lower surface of the pressing structure 17, and a lower end of the downstream filter 62 can abut against an upper surface of the support platform 222, so that the position of the downstream filter 62 can be stabilized, the mounting stability of the downstream filter 62 can be effectively enhanced, the stable and reliable operation of the downstream filter 62 can be ensured, and the filtering effect of the downstream filter 62 can be improved.

To sum up, in the above specific example of the present disclosure, when the user wishes to clean the downstream filter 62, the user can grasp the cup top cover 14 by hand and remove it vertically upward from the cup body by rotating it. Afterwards, it can be seen that the downstream filter 62 is sleeved over the hood 22, and then the user can grasp the downstream filter 62 and lift it upward to take it out. After taking out the downstream filter 62, the user can clear away the dust on its surface, and then wash it under tap water. After being cleaned, the downstream filter 62 is dried in the sun and then sleeved over the hood 22 again, and the cup top cover 14 is assembled to the cup body. Therefore, the handheld vacuum cleaner T according to the present embodiment can enable consumers to form a habit of cleaning the downstream filter 62 frequently, so that the vacuum cleaner can keep clean and ensure that the suction force is not weakened. Alternatively, the downstream filter 62 may be HEPA, i.e., a high efficiency particle air filter.

The handheld vacuum cleaner T according to some embodiments of the present disclosure will be described based on the arrangement of the upstream filter 61.

In some embodiments of the present disclosure, when the airflow generation device 2 is disposed on the downstream side of the cyclone separation device 3, the upstream filter 61 can be disposed between the airflow generation device 2 and the cyclone separation device 3. In one embodiment, the cyclone separation device 3 is disposed on an axial side of the airflow generation device 2. Therefore, the dust cup assembly T1 has a more compact and smaller structure and better stability.

In some embodiments of the present disclosure, the cup casing 1 can have an openable bottom, and for example, the lower case body 11 described above can be removed downward from the upper case body 13, or the cup bottom cover 12 can be opened downward. The cyclone separation device 3 is disposed below the airflow generation device 2, and the cyclone separation device 3 is detachably connected with the airflow generation device 2 or the cup casing 1 so as to be taken out downwards from the bottom of the cup casing 1 when the bottom of the cup casing 1 is opened. The upstream filter 61 is supported by the cyclone separation device 3 to move synchronously with the cyclone separation device 3. Therefore, when the user opens the bottom of the cup casing 1, the cyclone separation device 3 can be seen and removed from the cup casing 1 or the airflow generation device 2, and taken out downward. At this time, the upstream filter 61 supported by the cyclone separation device 3 can be moved downward together with the cyclone separation device 3. Thereafter, the user can remove the upstream filter 61 from the cyclone separation device 3 and perform related operations on the upstream filter 61, such as cleaning, replacement, maintenance, etc.

For example, after using the handheld vacuum cleaner T for a period of time, the user can open the bottom of the cup casing 1 as needed, remove the cyclone separation device 3 from the airflow generation device 2 or the cup casing 1 and take it out from the bottom of the cup casing 1. At this time, the upstream filter 61 can be taken out along with the cyclone separation device 3, so that the user can clean the cyclone separation device 3, or clean and replace the upstream filter 61, so as to keep the suction force of the handheld vacuum cleaner T and ensure the cleaning effect of the handheld vacuum cleaner T.

Therefore, according to the handheld vacuum cleaner T of the present embodiment, the upstream filter 61 can be taken out conveniently, and hence the user can clear away dust on the upstream filter 61 to keep the upstream filter 61 clean, and maintain the original dust absorption capacity and efficiency ratio of the handheld vacuum cleaner T.

In some specific examples of the present disclosure, referring to FIG. 4, the airflow generation device 2 includes the negative pressure unit 21 (e.g., the fan wheel 212 and the motor 211 connected to the fan wheel 212) and the hood 22 disposed outside and covering the negative pressure unit 21. The cyclone separation device 3 includes a cyclone separation member 31 and a mounting member 32 connected to the cyclone separation member 31, and the mounting member 32 is detachably connected to the hood 22. Hence, the airflow generation device 2 and the cyclone separation device 3 have simple structures and are easy to assemble and disassemble.

Figure 8:
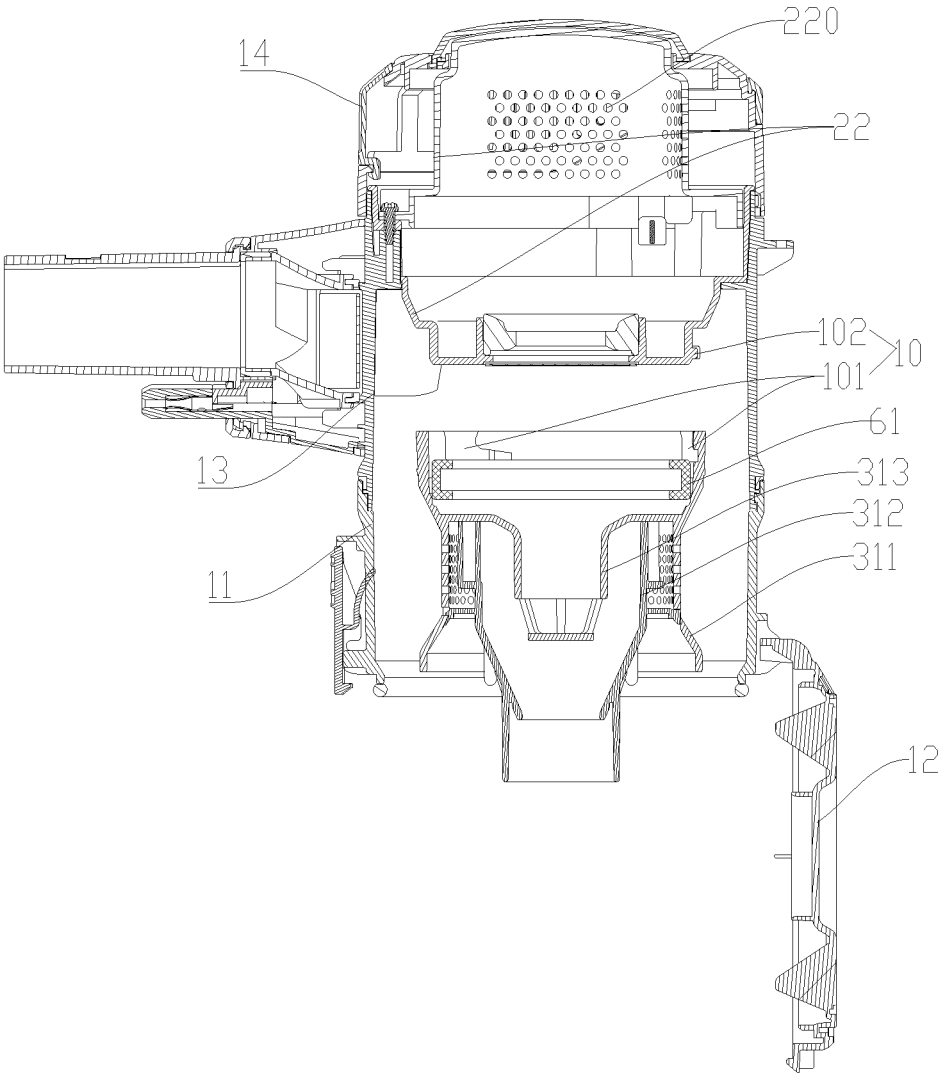
FIG. 8 is a schematic view illustrating that a cyclone separation device and the like are to be removed after a cup bottom cover of the handheld vacuum cleaner shown in FIG. 4 is opened.

Referring to FIG. 8, the cyclonic separation device 3 includes the cyclone separation member 31 and the mounting member 32 connected to the cyclone separation member 31, and the mounting member 32 is detachably connected to the hood 22. Specifically, the hood 22 has a hood vertical cylinder section 221. The mounting part 32 includes a mounting vertical cylinder section 321. The mounting vertical cylinder section 321 and the hood vertical cylinder section 221 are rotatably and detachably connected through a rotary buckling structure 10 or a rotary thread structure. Therefore, when the user needs to remove the cyclone separation device 3 from the airflow generation device 2, the cyclone separation device 3 can be removed by rotating the mounting vertical cylinder section 321 counterclockwise (or clockwise). Accordingly, when the user needs to mount the cyclone separation device 3 to the airflow generation device 2, the cyclone separation device 3 can be assembled to the airflow generation device 2 by rotating the mounting vertical cylinder section 321 in a direction opposite to the above direction. Therefore, the user can easily remove the cyclone separation device 3 from the airflow generation device 2 by simply rotating the cyclone separation device 3, in which way the required operation space is small, and the structure of the dust cup assembly T1 can be more compact.

In some embodiments of the present disclosure, referring to FIG. 8, an upper end of the mounting vertical cylinder section 321 and a lower end of the hood vertical cylinder section 221 are both cylindrical. The hood vertical cylinder section 221 and the mounting vertical cylinder section 321 are detachably connected through the rotary buckling structure 10, and the rotary buckling structure 10 includes a rotary insertion groove 101 and a rotary insertion strip 102. For example, in a specific example of the present disclosure, the rotary insertion groove 101 is formed in an inner peripheral surface of the upper end of the mounting vertical cylinder section 321 and has an opening at one end; the rotary insertion strip 102 is formed on an outer peripheral surface of the lower end of the hood vertical cylinder section 221 and is wedge-shaped; and the rotary insertion strip 102 extends into the rotary insertion groove 101 through the opening and is fitted and locked with the other end of the rotary insertion groove 101 through rotary motion. Therefore, the rotary buckling structure 10 has a simple structure and is convenient to process. disassemble and assemble. When mounting the hood vertical cylinder section 221 and the mounting vertical cylinder section 321, the user only needs to vertically mount the rotary insertion strip 102 into the rotary insertion groove 101 from an open end of the rotary insertion groove 101, and then rotate the hood vertical cylinder section 221 or mounting vertical cylinder section 321. When a clicking sound is heard, the mounting vertical cylinder section 321 and the hood vertical cylinder section 221 are assembled in place and locked together.

In other embodiments of the present disclosure, the upper end of the mounting vertical cylinder section 321 and the lower end of the hood vertical cylinder section 221 are both cylindrical. The hood vertical cylinder section 221 and the mounting vertical cylinder section 321 are detachably connected by a rotary thread structure (not shown in the drawings), and the rotary thread structure includes an internal thread and an external thread. For example, in a specific example of the present disclosure, the internal thread is formed on the inner peripheral surface of the upper end of the mounting vertical cylinder section 321, and the external thread is formed on the outer peripheral surface of the lower end of the hood vertical cylinder section 221 and is threadedly fitted with the internal thread. For example, in another specific example of the present disclosure, the internal thread is formed on an inner peripheral surface of the lower end of the hood vertical cylinder section 221, and the external thread is formed on an outer peripheral surface of the upper end of the mounting vertical cylinder section 321 and is threadedly fitted with the internal thread. Therefore, the rotary thread structure is simple, and is convenient to process, assemble and disassemble.

Certainly, the present disclosure is not limited thereto. In other embodiments of the present disclosure, the detachable connection between the hood vertical cylinder section 221 and the mounting vertical cylinder section 321 can also be realized in other ways. For example, the hood vertical cylinder section 221 and the mounting vertical cylinder section 321 can also be detachably connected by screw or hook structures. At this time, it is not required that the upper end of the mounting vertical cylinder section 321 and the lower end of the hood vertical cylinder section 221 are both cylindrical, so that the hood vertical cylinder section 221 and the mounting vertical cylinder section 321 can be selected in an expanded range, so as to better meet the actual requirements.

Referring to FIG. 4, the mounting member 32 further includes a mounting platform 322, the mounting platform 322 is connected to a lower end of the mounting vertical cylinder section 321 to define a mounting cavity with an open top together with the mounting vertical cylinder section 321, and the upstream filter 61 is disposed in the mounting cavity and supported on the mounting platform 322. As a result, the mounting member 32 has a simple structure and is convenient to process, and the structure of the mounting member 32 not only facilitates the disassembly and assembly with the airflow generation device 2, but also supports and limits the upstream filter 61 effectively, thereby allowing the user to remove the upstream filter 61 from the mounting member 32 and remount it conveniently, and facilitating the cleaning, replacement, and maintenance of the upstream filter 61. In one embodiment, the mounting platform 322 is an annular platform. As a result, the cyclone separation device 3 can efficiently supply air to the airflow generation device 2 through an inner ring of the mounting platform 322, thereby improving the dust absorption efficiency while ensuring the stable installation of the upstream filter 61.

In some embodiments of the present disclosure, referring to FIG. 4, the cyclone separation member 31 can include a cyclone separator group and a filter cartridge 313 provided in the cyclone separator group. Therefore, clean air filtered by the cyclone separator group can flow out through the filter cartridge 313, thereby improving the cleaning and filtering effect. Certainly, the present disclosure is not limited thereto, and in some other embodiments of the present disclosure, the cyclone separation member 31 can include only the cyclone separator group, without the filter cartridge 313. The following description will elaborate the cyclone separation member 31 including both the cyclone separator group and the filter cartridge 313 by way of example.

Referring to FIG. 4, the cyclone separator group can include a primary cyclone separator 311 and a secondary cyclone separator 312 provided in the primary cyclone separator 311, in which case the filter cartridge 313 is provided in the secondary cyclone separator 312. For example, in the example shown in FIG. 4, the primary cyclone separator 311 can be formed in a generally cylindrical structure, a plurality of first air inlets 3111 are provided in the primary cyclone separator 311, the secondary cyclone separator 312 is provided in the primary cyclone separator 311, and the secondary cyclone separator 312 can be formed in a generally conical structure, and A second air inlet 3121 can be provided in a side wall of an upper end of the secondary cyclone separator 312.

Therefore, during the operation of the handheld vacuum cleaner T, airflow can enter tangentially between the cup casing 1 and the primary cyclone separator 311 through the suction channel S1 to undergo first cyclone separation, then enter tangentially between the secondary cyclone separator 312 and the filter cartridge 313 through the first air inlets 3111 in the primary cyclone separator 311 and the second air inlet 3121 in the secondary cyclone separator 312 to undergo second cyclone separation, and then flow to the airflow generation device 2 through the filter cartridge 313. Certainly, the present disclosure is not limited thereto, and the cyclone separator group can also be constructed into other structures to realize single-stage cyclone filtration or two or more stages of cyclone filtration, that is, the cyclone separator group can be of a single-cone structure or a multi-cone structure.

In one embodiment, referring to FIG. 4, the filter cartridge 313 is barrel-shaped, and has an air outlet 3130 at an axial end, and a dust retaining end surface 3131 provided at the other axial end. The dust retaining end surface 3131 is formed as a curved surface protruding away from the air outlet 3130. For example, in examples shown in FIGS. 9 and 10, the air outlet 3130 is provided in an upper end of the filter cartridge 313, the dust retaining end surface 3131 is provided to a lower end of the filter cartridge 313, and the dust retaining end surface 3131 is formed into a curved surface protruding downward. Therefore, by providing the dust retaining end surface 3131, fine dust can be blocked outside the filter cartridge 313 by the dust retaining end surface 3131 and can be prevented from flowing to the upstream filter 61 and the motor 211 and hence from polluting the upstream filter 61 and the motor 211, so as to ensure the dust absorption effect of the vacuum cleaner and improve the working life of the motor 211.

Figure 9:
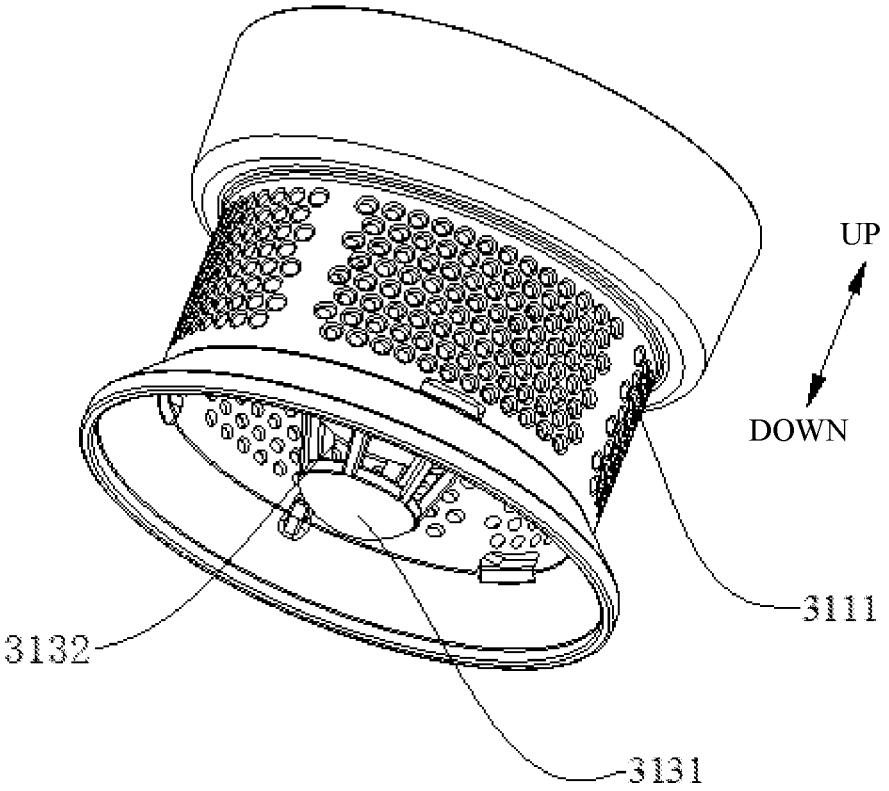
FIG. 9 is a perspective view illustrating a primary cyclone separator and a filter cartridge shown in FIG. 4.
Figure 10:
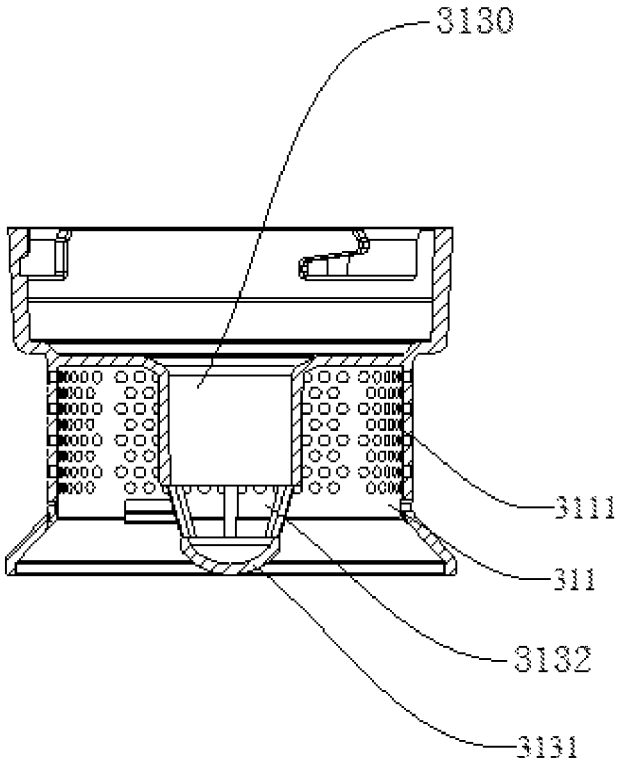
FIG. 10 is a sectional view illustrating the primary cyclone separator and the filter cartridge shown in FIG. 9.

Optionally, referring to FIGS. 9 and 10, the dust retaining end surface 3131 can be configured as an arc-shaped surface, such as a semi-spherical curved surface, whereby the dust retaining end surface 3131 can have a larger dust contact area to further improve the dust retaining effect, and can be suitable for indoor use with low noise and no sharp noise.

In some specific examples of the present disclosure, referring to FIGS. 9 and 10, the dust retaining end surface 3131 can be a closed curved surface. At this time, an end of the filter cartridge 313 close to the dust retaining end surface 3131 has a plurality of air intake gaps 3132. For example, the dust retaining end surface 3131 can be connected to the lower end of the filter cartridge 313 through a plurality of connecting ribs, the plurality of connecting ribs are spaced apart along a circumferential direction of the dust retaining end surface 3131, and the air intake gap 3132 can be defined between two adjacent connecting ribs. At this time, when the fine dust hits the dust retaining end surface 3131 upward, it can be rebounded and fall, that is, the fine dust can be blocked outside the filter cartridge 313 by the dust retaining end surface 3131, and clean air can enter the filter cartridge 313 through the air inlet gap 3132 and be discharged toward the air outlet 3130. Therefore, the dust retaining effect is better, and the dust retaining end surface 3131 has a simple structure, reliable connection and convenient processing.

Certainly, the present disclosure is not limited thereto. For example, in some other specific examples of the present disclosure, the dust retaining end surface 3131 may not be configured as a closed curved surface. In this case, the dust retaining end surface 3131 and/or the end of the filter cartridge 313 close to the dust retaining end surface 3131 have a plurality of air inlet micro-holes (not shown in the drawings). That is, the plurality of air inlet micro-holes can be provided only in the dust retaining end surface 3131, or the plurality of air inlet micro-holes are provided only at the end of the filter cartridge 313 close to the dust retaining end surface 3131 (e.g., a lower end in FIG. 2), or the plurality of air inlet micro-holes are provided in the dust retaining end surface 3131 and the end of the filter cartridge 313 close to the dust retaining end surface 3131 at the same time, so that clean air can enter the filter cartridge 313 through the air inlet micro-holes and be discharged toward the air outlet 3130. Therefore, the dust retaining end surface 3131 has a simple structure and is convenient to process.

Optionally, as shown in FIG. 4, the filter cartridge 313 and the primary cyclone separator 311 are configured into one piece, and the secondary cyclone separator 312 and the primary cyclone separator 311 are detachably connected. That is, the filter cartridge 313 and the primary cyclone separator 311 are one integral and inseparable component, while the secondary cyclone separator 312 and the primary cyclone separator 311 are two independent and separable components. For example, the secondary cyclone separator 312 and the primary cyclone separator 311 can be connected by a snap or the like. Therefore, after taking out the cyclone separation device 3, the user can separate the primary cyclone separator 311 and the secondary cyclone separator 312 for further cleaning, thereby improving the cleaning effect of the handheld vacuum cleaner T.

Thus, in the dust cup assembly T1 according to the above embodiments of the present disclosure, the airflow generation device 2, the upstream filter 61, and the cyclone separation device 3 are sequentially arranged from top to bottom. The upstream filter 61 is supported on the cyclone separation device 3, and the cyclone separation device 3 includes the primary cyclone separator 311 and the secondary cyclone separator 312 which are detachably connected (e.g., detachably connected through a snap structure). The primary cyclone separator 311 has the filter cartridge 313 in the center thereof and is mounted at the bottom of the airflow generation device 2 through the mounting member 32.

In this way, when the user wishes to clean the upstream filter 61 and the cyclone separation device 3, the bottom of the cup casing 1 can be opened, such that the cyclone separation device 3 can be rotated and taken out downwards along with the upstream filter 61, then the upstream filter 61 can be removed from the cyclone separation device 3, and the secondary cyclone separator 312 can be removed from the primary cyclone separator 311, in which way the removed components can be cleaned one by one. Therefore, the dust cup assembly T1 has a simple and compact structure, and is convenient to assemble, disassemble and clean. Optionally, the upstream filter 61 may be HEPA, i.e., a high efficiency particle air filter.

Finally, the handheld vacuum cleaner T according to some specific embodiments of the present disclosure will be described based on an air duct layout of the dust cup assembly T1.

Figure 11:
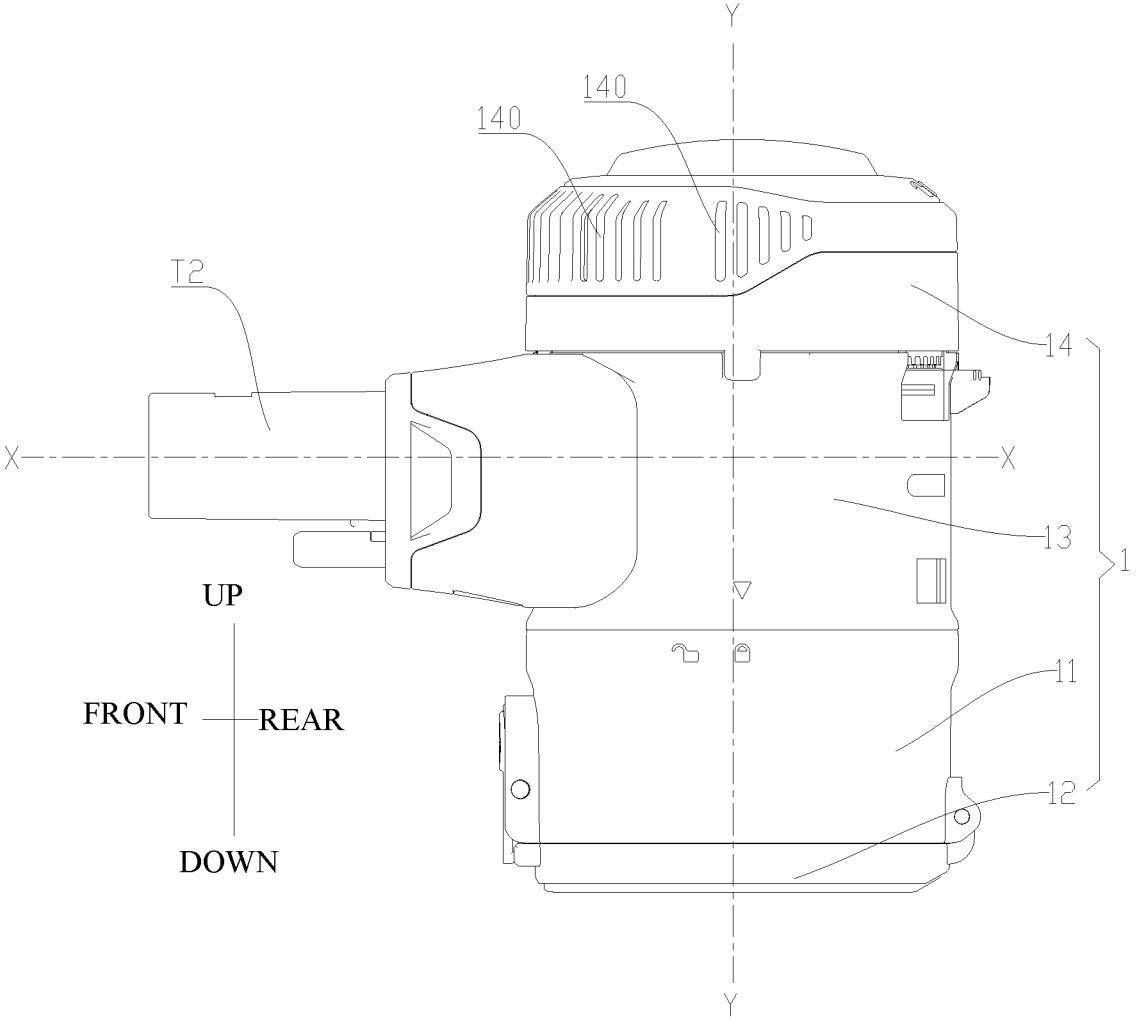
FIG. 11 is a partial front view illustrating a handheld vacuum cleaner according to an embodiment of the present disclosure.

In some embodiments of the present disclosure, referring to FIGS. 4 and 11, the top of the cup casing 1 is formed with an air vent 140, and for example, the air vent 140 is formed in the cup top cover 14 described above. Therefore, after the dusty air sucked into the cup casing 1 is cleaned and filtered, the cleaned air can be directly discharged through the air vent 140 at the top of the cup casing 1 without need to turn to a farther place for exhaust, thereby effectively shortening an exhaust path and reducing the energy consumption. Moreover, compared with a solution of air exhaust through the bottom of the cup casing 1, since the air is exhausted from the top of the cup casing 1, the problem that the dust on the surface to be cleaned is blown scattered by the air exhausted downwards can be avoided, and the cleaning effect of the handheld vacuum cleaner T is improved.

According to the embodiments described above, when the airflow enters the interior of the cup casing 1 tangentially through the suction channel S1, the centrifugal force can be generated to throw out the dust. The dust can rotate along the inner wall of the cup casing 1 and move downward to the bottom of the cup, or can be blocked by the dust retaining rib 16 to stay on one side of the dust retaining rib 16 and accumulate. The filtered air can flow upward to the upstream filter 61 through the primary cyclone separator 311, the secondary cyclone separator 312 and the filter cartridge 313, and enters the airflow generation device 2 through the upstream filter 61 upwards, then flows upwards through the airflow generation device 2 to the downstream filter 62, and finally is discharged through the air vent 140 at the top of the cup casing 1. Therefore, the handheld vacuum cleaner T according to the embodiments of the disclosure has the simple structure, more compact appearance, compact air duct layout, large dust capacity and good dust removal effect, and is convenient to clean and low in energy consumption.

In one embodiment, referring to FIGS. 4 and 11, the downstream filter 62 is opposite to the air vent 140. Therefore, the airflow filtered by the downstream filter 62 can be directly discharged through the air vent 140, thereby further shortening the exhaust distance and reducing the energy consumption. For example, in a specific example of the present disclosure, the air vent 140 can be arranged around the downstream filter 62, such that on the premise of ensuring the shortest exhaust path, the exhaust angle range can be widened to effectively improve the exhaust efficiency and the overall energy efficiency of the handheld vacuum cleaner T.

In some embodiments of the present disclosure, the suction nozzle assembly T2 is transversely mounted to the cup casing 1, so that an axial direction X-X of the suction channel S1 extends transversely, and projected onto a vertical plane, a blowing direction of the air vent 140 is inclined upward relative to the axial direction of the suction channel S1. Therefore, it is explained that the blowing direction of the air vent 140 intersects with a suction direction of the suction channel S1 at a certain angle, so that when the suction channel S1 is aligned with the surface to be cleaned, the blowing direction of the air vent 140 does not face the surface to be cleaned, thereby avoiding the problem that the air sent from the air vent 140 blows away the dust on the surface to be cleaned and hence ensuring the cleaning effect.

Figure 12:
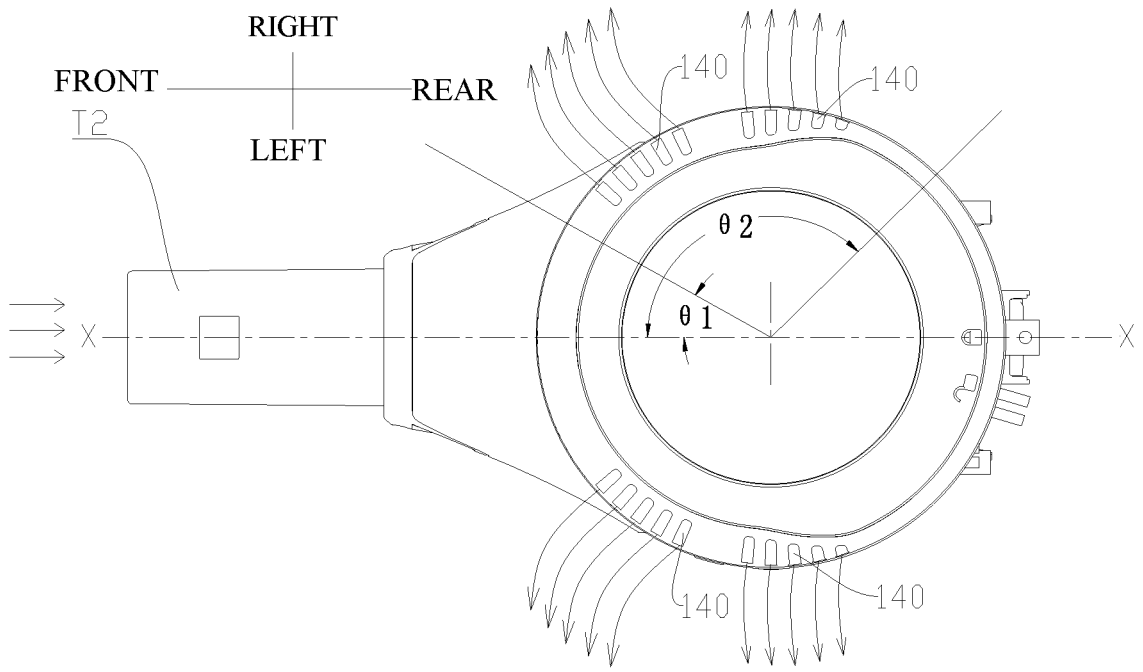
FIG. 12 is a top view illustrating the handheld vacuum cleaner shown in FIG. 11.
Figure 13:
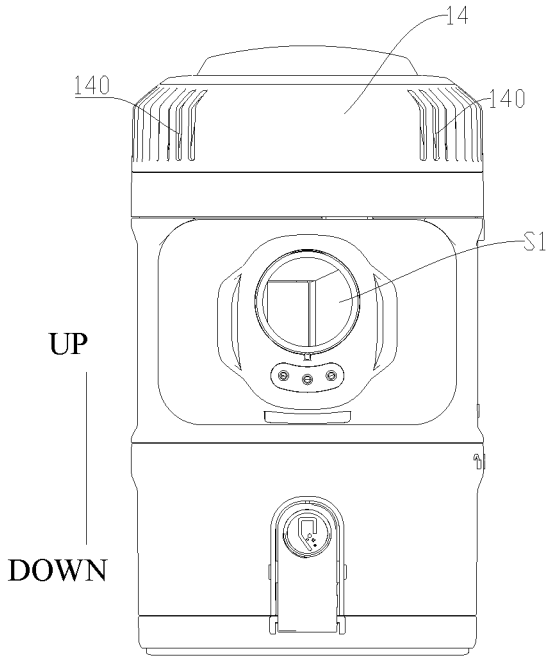
FIG. 13 is a side view illustrating the handheld vacuum cleaner shown in FIG. 11.

In some embodiments of the present disclosure, referring to FIGS. 11-13, an angle θ between the axial direction X-X of the suction channel S1 and the blowing direction of the air vent 140 is projected to a horizontal plane and satisfies: $\theta 1 \leq \theta \leq \theta 2$, where $\theta 1=20°$ and $\theta 2=120°$. That is, taking the central axis of the cup casing 1 as a rotation center, the air vent 140 can be processed in an included angle range obtained by sequentially rotating the axis of the suction channel S1 by 20° and 120° clockwise, and the air vent 140 can also be processed in an included angle range obtained by sequentially rotating the axis of the suction channel S1 by 20° and 120° counterclockwise.

Therefore, when the user uses the handheld vacuum cleaner T to perform cleaning, the suction channel S1 faces the surface to be cleaned (such as the ground or furniture). Since the blowing direction is at an included angle relative to the suction channel S1, the blowing direction will not face the surface to be cleaned, thus avoiding the problem that the wind blows away the dust and affects the dust absorption (i.e., avoiding raising dust), and ensuring the cleaning effect, and the blowing direction will not face backwards to the user, thus avoiding the problem that the user feels uncomfortable when the wind is blown to the user.

In some embodiments of the present disclosure, θ may also satisfy: $30°\theta \leq 105°$. That is, taking the central axis of the cup casing 1 as the rotation center, the air vent 140 can be processed in an included angle range obtained by sequentially rotating the axis of the suction channel S1 by 30° and 105° clockwise, and the air vent 140 can be processed in an included angle range obtained by sequentially rotating the axis of the suction channel S1 by 30° and 105° counterclockwise. Therefore, the above beneficial effects can be better exerted.

Figure 14:
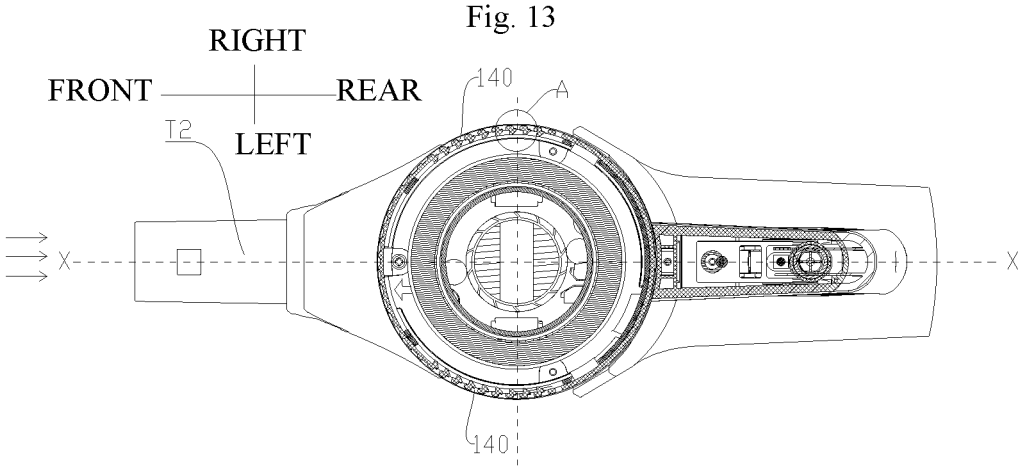
FIG. 14 is a top sectional view illustrating a handheld vacuum cleaner according to an embodiment of the present disclosure.
Figure 15:
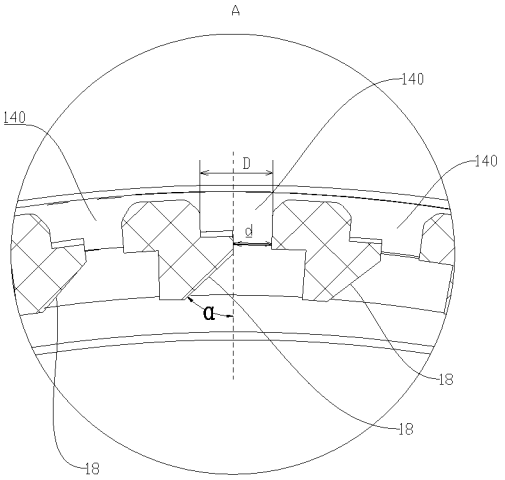
FIG. 15 is an enlarged view of part A shown in FIG. 14.

In some specific examples of the present disclosure, referring to FIGS. 14 and 15, an inner side of the air vent 140 is provided with an air guide surface 18 for adjusting the blowing direction thereof. Along a direction perpendicular to and away from the axis of the suction channel S1, the air guide surface 18 extends toward a direction close to the handle assembly T3, and an included angle α between an extension line of the air guide surface 18 and a connection line between a center point of the air vent 140 and a center point of the cup casing 1 is projected to the horizontal plane and satisfies: $10° \leq \alpha \leq 90°$. Therefore, it is possible to simply and effectively ensure that the air vent 140 blows air toward a position far away from the suction direction. Therefore, when the user uses the handheld vacuum cleaner T to perform cleaning, the suction channel S1 faces the surface to be cleaned (such as the ground or furniture). Since the blowing direction is at an included angle relative to the suction channel S1, the blowing direction will not face the surface to be cleaned, thus avoiding the problem that the wind blows away the dust and affects the dust absorption (i.e., avoiding raising dust), and ensuring the cleaning effect, and the blowing direction will not face backwards to the user, thus avoiding the problem that the user feels uncomfortable when the wind is blown to the user.

In one embodiment, referring to FIGS. 14 and 15, projected onto the horizontal plane, a width D between a front side wall of the air vent 140 (i.e., a side wall close to the suction nozzle assembly T2) and a rear side wall of the air vent 140 (i.e., a side wall close to the handle assembly T3) is larger than a width d between a rear side wall (i.e., a side wall close to the handle assembly T3) of an outer edge of the air guide surface 18 (i.e., an edge away from the central axis of the cup casing 1) and the rear side wall of the air vent 140 (i.e., the side wall close to the handle assembly T3). Therefore, when the airflow is discharged outward from the inside of the cup casing 1 through the air guide surface 18 and the air vent 140, the airflow first flows through the smaller flow-through width d, and then flows through the larger flow-through width D. Thus, the exhaust resistance can be effectively reduced, the exhaust noise can be lowered, and the exhaust efficiency can be improved. Optionally, the width d between the rear side wall of the outer edge of the air guide surface 18 and the rear side wall of the air vent 140 satisfies: $2\ mm \leq d \leq 6\ mm$.

In one embodiment, the air vent 140 has a flared shape along the blowing direction of the air vent 140. In other words, when the airflow is discharged from the inside of the cup casing 1 through the air guide surface 18, the airflow can be gradually diffused and discharged outward from the air vent 140, so that the exhaust resistance can be effectively reduced, the exhaust noise can be lowered, and the exhaust efficiency can be improved.

In some embodiments of the present disclosure, referring to FIG. 12, a plurality of air vents 140 are provided, and the plurality of air vents 140 projected onto the horizontal plane are symmetrically distributed about the axis X-X of the suction channel S1. That is, when the suction nozzle assembly T2 is disposed on a front side of the dust cup assembly T1 and the handle assembly T3 is disposed on a rear side of the dust cup assembly T1, the plurality of air vents 140 are symmetrically provided on the left and right sides of the top of the cup casing 1, respectively. Thus, the layout of the air vents 140 is more ingenious and beautiful, and the blowing effect is better.

In some embodiments of the present disclosure, referring to FIG. 13, the air vent 140 can be processed into an elongated shape extending in an up-down direction, thereby improving a blowing area and the blowing efficiency. Furthermore, the air vent 140 is easier to process, avoiding a problem that divergence of a blowing angle affects air suction or causes discomfort to users. Certainly, the present disclosure is not limited thereto. In other embodiments of the present disclosure, the air vent 140 may be formed into a circle, an oval, a regular polygon, a diamond or the like, to better meet the actual requirements.

The handheld vacuum cleaner T according to some specific embodiments of the present disclosure will be described based on the relative layout of the suction nozzle assembly T2 and the dust cup assembly T1.

In some embodiments of the present disclosure, referring to FIG. 22, the airflow generation device 2 and the cyclone separation device 3 are sequentially arranged along a direction perpendicular to the axis direction X-X of the suction channel S1. That is to say, a connection line between a center of the airflow generation device 2 and a center of the cyclone separation device 3 is perpendicular to the axis of the suction channel S1 (here, it should be noted that the term "perpendicular" herein is understood broadly, that is, it is not necessary to be perpendicular in an absolutely strict sense, and for example, it is also possible to have a small included angle). For example, when the cup casing 1 is vertically arranged, the suction nozzle assembly T2 is transversely mounted to the cup casing 1, and the cyclone separation device 3 and the airflow generation device 2 can be arranged in the up-down direction. At this time, the axis X-X of the suction channel S1 can be horizontally arranged, and the connection line between the center of the airflow generation device 2 and the center of the cyclone separation device 3 is vertically arranged. As a result, the layout of the dust cup assembly T1 is more compact and smaller, thereby adapting to the miniaturization trend of the handheld vacuum cleaner T.

In some embodiments of the present disclosure, referring to FIG. 22, the cyclone separation device 3 and the airflow generation device 2 are arranged along an axial direction of the cup casing 1. For example, when the cup casing 1 is vertically arranged, the cyclone separation device 3 is arranged above the airflow generation device 2, or the airflow generation device 2 is arranged above the cyclone separation device 3. Therefore, the layout of the dust cup assembly T1 is more compact and small, and occupies a smaller area, thus adapting to the miniaturization trend of the handheld vacuum cleaner T.

In some embodiments of the present disclosure, referring to FIG. 4, the negative pressure unit 21 can include the motor 211 and the fan wheel 212 connected to a rotating shaft of the motor 211, so that the motor 211 can drive the fan wheel 212 to rotate to generate negative pressure to realize air suction. Therefore, the negative pressure unit 21 has a simple structure and is convenient to process and install. Certainly, the present disclosure is not limited thereto, and the negative pressure unit 21 may also be other units having a driving component and an executing component. For example, the negative pressure unit 21 may also be a vacuum pump having a motor or the like. Next, referring to FIGS. 16 to 19, the dust cup assembly T1 according to various embodiments of the present disclosure will be described based on several optional mounting modes of the motor 211.

Figure 16:
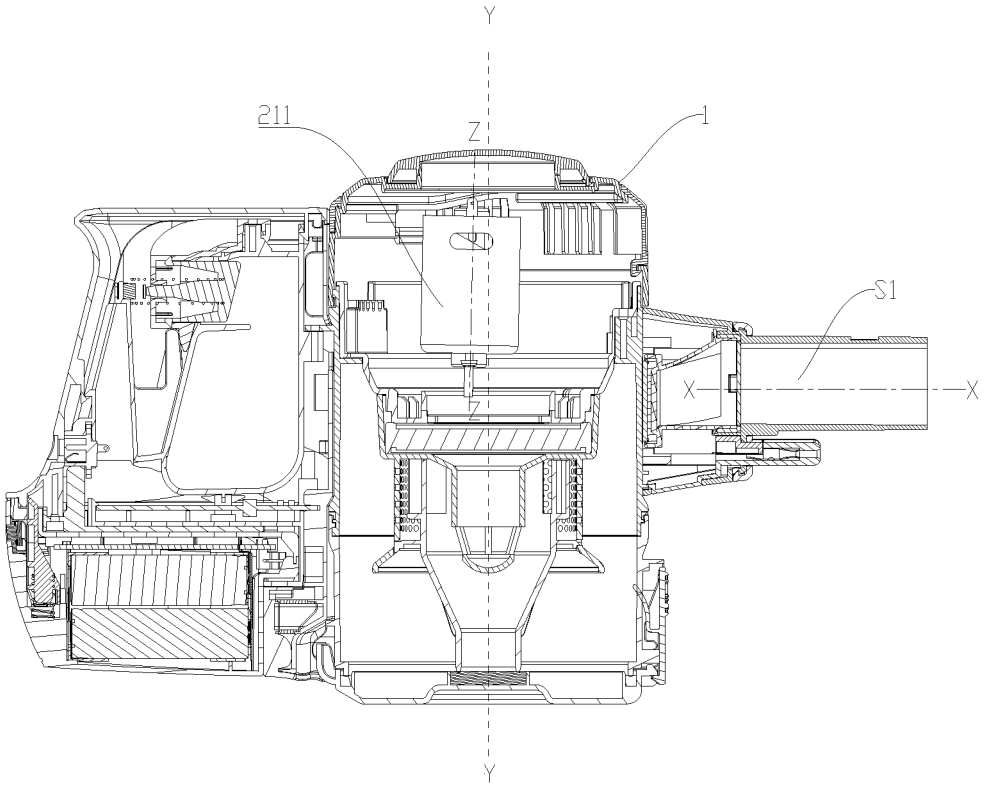
FIG. 16 is a front sectional view illustrating a handheld vacuum cleaner according to an embodiment of the present disclosure.
Figure 17:
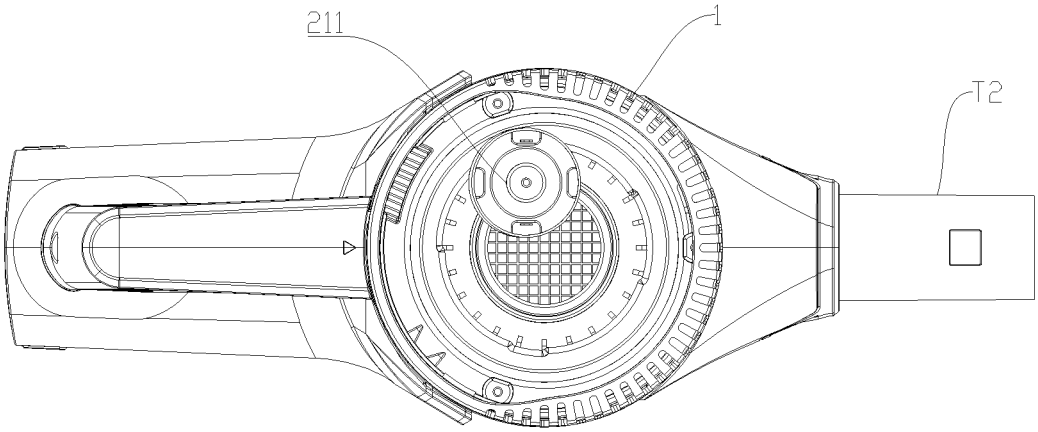
FIG. 17 is a top sectional view illustrating the handheld vacuum cleaner shown in FIG. 16.

In some specific examples of the present disclosure, referring to FIGS. 16-17, the motor 211 can be mounted perpendicular to the suction channel S1. At this time, the axis X-X of the suction channel S1 intersects with a rotation axis Z-Z of the motor 211 at a right angle. Further, the motor 211 can be mounted vertically and offset from the suction channel S1. For example, in a specific example of the disclosure, the cup casing 1 is cylindrical, the central axis Y-Y of the cup casing 1 is parallel to but not coincident with the rotation axis Z-Z of the motor 211, and the axis X-X of the suction channel S1 intersects with and is perpendicular to the central axis Y-Y of the cup casing 1. Therefore, on the premise of ensuring stable installation of the dust cup assembly T1, the motor 211 can also effectively avoid the internal components of the cup casing 1 and improve the assembly flexibility of the dust cup assembly T1. For example, optionally, the cup casing 1 can be cylindrical, the central axis of the cup casing 1 is vertically disposed, the motor 211 is vertically provided in the cup casing 1, and the suction nozzle assembly T2 is transversely mounted to the cup casing 1. The central axis Z-Z of the motor 211 is offset from the central axis Y-Y of the cup casing 1, and the central axis X-X of the suction channel S1 is perpendicular to and intersects with the central axis Y-Y of the cup casing 1. Therefore, the installation and assembly is convenient, and the center of gravity of the dust cup assembly T1 is more stable.

Figure 18:
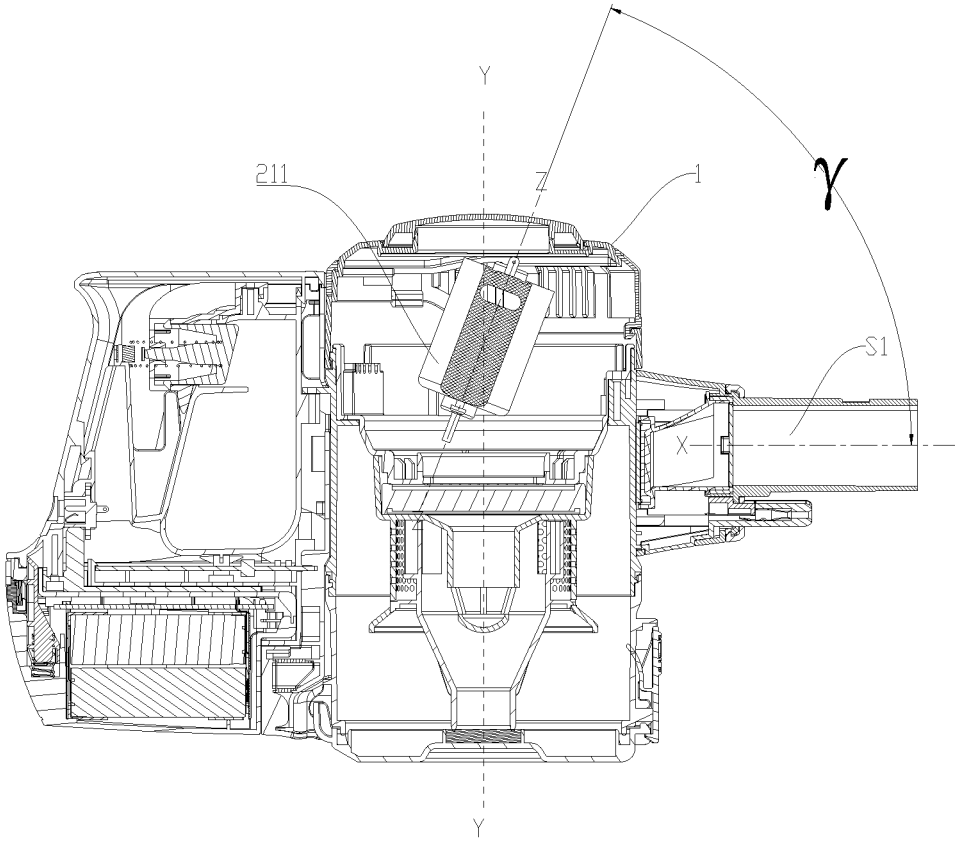
FIG. 18 is a front sectional view illustrating a handheld vacuum cleaner according to an embodiment of the present disclosure.

In some specific examples of the present disclosure, referring to FIG. 18, the motor 211 can be mounted obliquely to the suction channel S1. At this time, the axis X-X of the suction channel S1 intersects with the rotation axis Z-Z of the motor 211 at an acute angle or an obtuse angle. As a result, the motor 211 can effectively avoid the internal components of the cup casing 1 and improve the assembly flexibility of the dust cup assembly T1. For example, the cup casing 1 can be cylindrical, the central axis Y-Y of the cup casing 1 is vertically arranged, the motor 211 is obliquely arranged in the cup casing 1, and the suction nozzle assembly T2 is transversely mounted to the cup casing 1. Therefore, it is convenient to process, install and assemble, and the center of gravity of the dust cup assembly T1 is more stable. In one embodiment, an intersection angle $\gamma$ between the axis X-X of the suction channel S1 and the rotation axis Z-Z of the motor 211 satisfies: $20° \leq \gamma \leq 70°$. Thereby, not only the structure of the dust cup assembly T1 can be ensured to be compact and small, but also the mounting stability of the dust cup assembly T1 can be improved.

Figure 19:
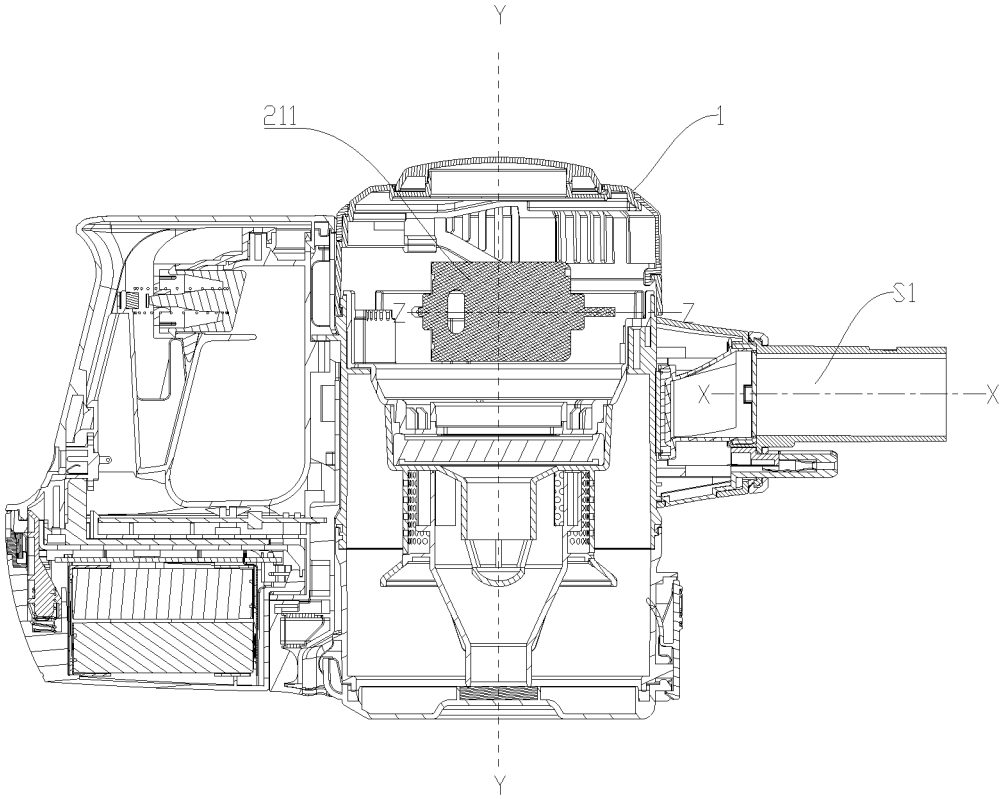
FIG. 19 is a front sectional view illustrating a handheld vacuum cleaner according to an embodiment of the present disclosure.

In some specific examples of the present disclosure, referring to FIG. 19, the motor 211 can be mounted parallel to or coaxial with the suction channel S1. At this time, the axis X-X of the suction channel S1 is parallel to or coincident with the rotation axis Z-Z of the motor 211. As a result, the height of the dust cup assembly T1 can be lower, the center of gravity of the whole machine is more stable, and the motor 211 can effectively avoid the internal components of the cup casing 1, thus improving the assembly flexibility of the dust cup assembly T1. For example, the cup casing 1 can be cylindrical and the central axis Y-Y of the cup casing 1 is vertically arranged. At this time, the motor 211 is transversely arranged in the cup casing 1, and the suction nozzle assembly T2 is transversely installed to the cup casing 1. Therefore, it is convenient to process, install and assemble, and the center of gravity of the dust cup assembly T1 is more stable. In one embodiment, the axis X-X of the suction channel S1 is arranged parallel to and below the rotation axis Z-Z of the motor 211. Thereby, not only the structure of the dust cup assembly T1 can be ensured to be compact and small, but also the mounting stability of the dust cup assembly T1 can be improved.

Figure 20:
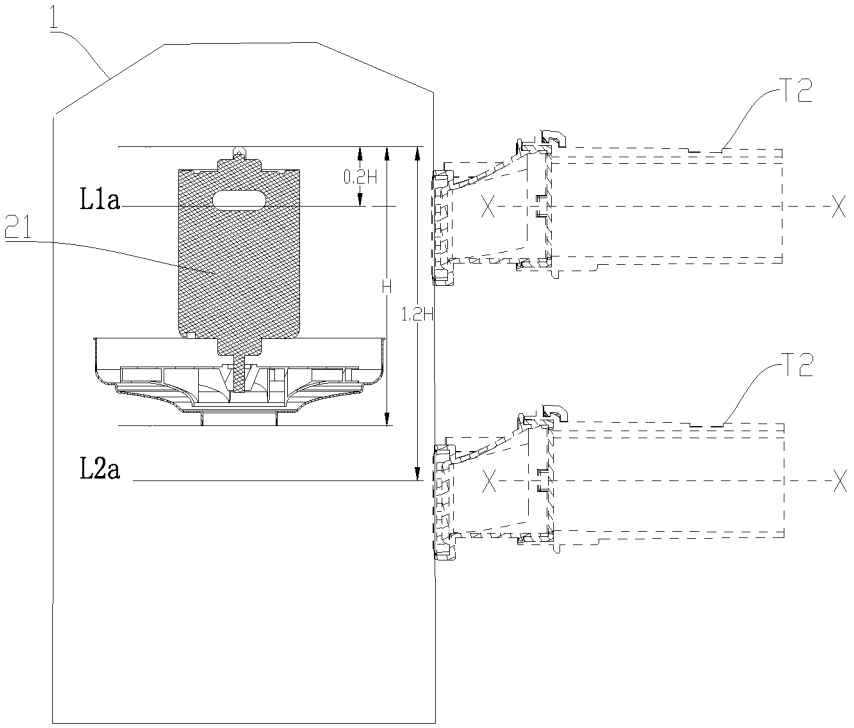
FIG. 20 is a schematic view illustrating a handheld vacuum cleaner according to some embodiments of the present disclosure.

In some embodiments of the present disclosure, referring to FIGS. 4 and 20, the airflow generation device 2 includes the negative pressure unit 21 and the hood 22 disposed outside and covering the negative pressure unit 21. The axis X-X of the suction channel S1 extends horizontally and is located below a top end of the negative pressure unit 21. A vertical distance L between the axis X-X of the suction channel S1 and the top end of the negative pressure unit 21 satisfies L≥0.2 H, in which H is the height of the negative pressure unit 21 in the vertical direction. That is, a reference line L1*a* is drawn at a distance of 0.2 H from the top end of the negative pressure unit 21 and below the negative pressure unit 21, and the axis of the suction channel S1 is located below the reference line L1*a*. Therefore, the arrangement position of the suction nozzle assembly T2 is ingenious, which can effectively avoid the problem that the whole handheld vacuum cleaner T topples, and improve the placement stability of the handheld vacuum cleaner T. In addition, when the air vent 140 is arranged at the top of the cup casing 1, given L≥0.2 H, the problem that the dust absorption of the suction channel S1 is influenced by the blowing direction of the air vent 140 can be effectively avoided, and the dust absorption effect is improved.

Further, in some embodiments of the present disclosure, the vertical distance L between the axis of the suction channel S1 and the top end of the negative pressure unit 21 further satisfies: 0.2 H≤L≤1.2 H. That is, a reference line L2*a* is drawn at a distance of 1.2 H from the top end of the negative pressure unit 21 and below the negative pressure unit 21, and the axis of the suction channel S1 is located below the reference line L1*a* and above the reference line L2*a*. Therefore, the problem that the whole handheld vacuum cleaner T topples can be further avoided; the placement stability of the handheld vacuum cleaner T can be improved; the problem that the dust absorption of the suction channel S1 is influenced by the blowing direction of the air vent 140 can be effectively avoided; and the dust absorption effect is improved.

In some embodiments of the present disclosure, referring to FIGS. 4 and 21, the axis X-X of the suction channel S1 extends horizontally and is located below a top end of the cup casing 1. The vertical distance L between the axis of the suction channel S1 and the top end of the cup casing 1 satisfies 0.2 S≤L≤0.8 S, in which S is the height of the cup casing 1 in the vertical direction. That is, a reference line L1*b* is drawn at a distance of 0.2 S from the top end of the cup casing 1 and below the cup casing 1, a reference line L2*b* is drawn at a distance of 0.8 S from the top end of the cup casing 1 and below the cup casing 1, and the axis of the suction channel S1 is below the reference line L1*b* and above the reference line L2*b*. Therefore, the arrangement position of the suction nozzle assembly T2 is ingenious, which can effectively avoid the problem that the whole handheld vacuum cleaner T topples, and improve the placement stability of the handheld vacuum cleaner T. In addition, when the air vent 140 is arranged at the top of the cup casing 1, given 0.2 S≤L≤0.8S, the problem that the dust absorption of the suction channel S1 is influenced by the blowing direction of the air vent 140 can be effectively avoided, and the dust absorption effect is improved.

Here, it should be noted that in some of the above embodiments describing the installation height of the suction nozzle assembly T2, the negative pressure unit 21 can include the motor 211 and the fan wheel 212 connected to the motor 211, and the rotation axis of the motor 211 can be arranged vertically, horizontally, or obliquely, that is, the included angle γ between the central axis of the motor 211 and the axis of the suction channel S1 satisfies: 0°≤γ≤90°, whereby various practical requirements can be satisfied.

In one embodiment, the included angle γ between the axis of the suction channel S1 and the rotation axis of the motor 211 satisfies: 30°≤γ≤90°. Thus, the layout of the dust cup assembly T1 is more compact and small, and the placement stability is enhanced. Further, the fan wheel 212 can be connected to the bottom of the motor 211, so that the dust absorption effect of the airflow generation device 2 is better, and the installation and arrangement is more convenient. Thus, the layout of the dust cup assembly T1 is more compact and small. In one embodiment, the axis of the suction channel S1 intersects with the rotation axis of the motor 211. That is, the axis X-X of the suction channel S1 and the rotation axis Z-Z of the motor 211 can be located in the same plane, so that the placement stability of the dust cup assembly T1 can be further improved.

Figure 21:
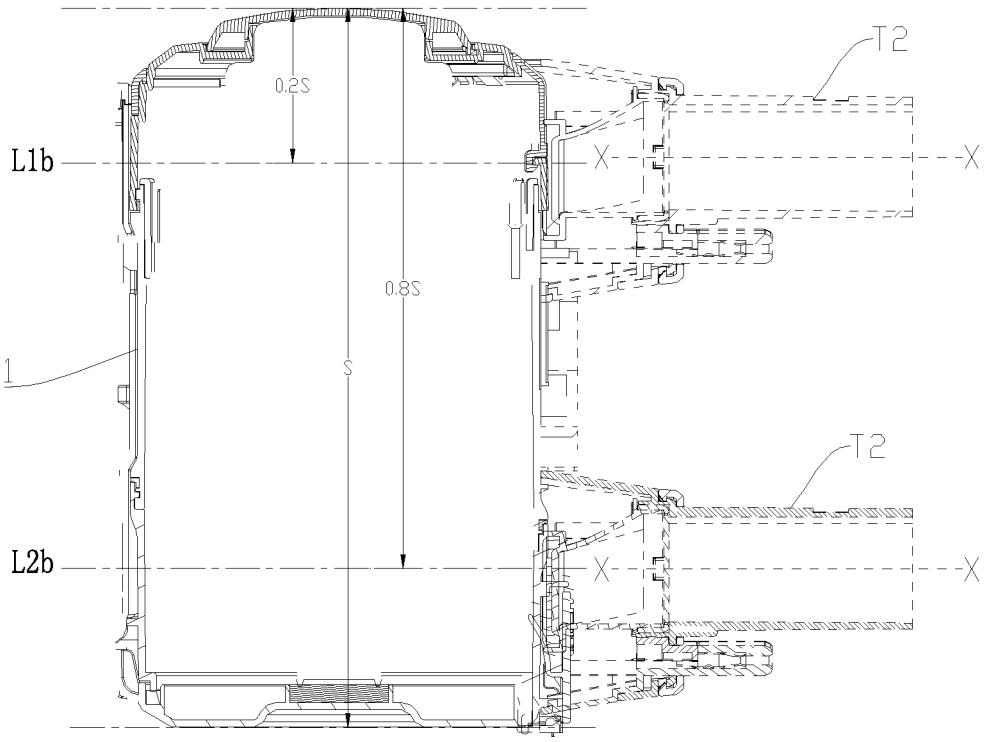
FIG. 21 is a schematic view illustrating a handheld vacuum cleaner according to some embodiments of the present disclosure.

In some embodiments of the present disclosure, referring to FIGS. 20 and 21, the suction nozzle assembly T2 can be detachably connected with the cup casing 1. Therefore, when it is necessary to adjust an installation position of the suction nozzle assembly T2 or perform relevant operations on the suction nozzle assembly T2, the user can detach the suction nozzle assembly T2 from the cup casing 1 and perform the relevant operations. As a result, it is convenient for the user to use and handle it as needed. For example, the suction nozzle assembly T2 can be detachably connected with the cup casing 1 through a snap structure, a thread structure, or the like.

The handheld vacuum cleaner T according to some specific embodiments of the present disclosure will be described based on the relative layout of the handle assembly T3 and the dust cup assembly T1 and the structural characteristics of the handle assembly T3.

In some embodiments of the present disclosure, referring to FIG. 22, the handle assembly T3 is detachably connected with the cup casing 1. Therefore, when it is necessary to adjust an installation position of the handle assembly T3 or perform relevant operations on the handle assembly T3, the user can detach the handle assembly T3 from the cup casing 1 and perform the relevant operations. As a result, it is convenient for the user to use and handle it as needed. For example, the handle assembly T3 can be detachably connected with the cup casing 1 through a snap structure, a thread structure, or the like.

In some embodiments of the present disclosure, referring to FIG. 22, the handle assembly T3 and the suction nozzle assembly T2 are located on both sides of the dust cup assembly T1 along the axial direction X-X of the suction channel S1, respectively. That is, when the user holds the handle assembly T3 on the rear side of the dust cup assembly T1, the suction nozzle assembly T2 on the front side of the dust cup assembly T1 can perform a dust suction operation. Therefore, it is convenient for the user to operate.

In some embodiments of the present disclosure, referring to FIG. 22, when the airflow generation device 2 is disposed inside the cup casing 1 rather than inside the handle assembly T3, a bottom surface F1 of the cup casing 1 is lower than a bottom surface F2 of the handle assembly T3 to serve as an independent support surface when the handheld vacuum cleaner T is placed. That is, when the handheld vacuum cleaner T is placed on the horizontal plane, no part other than the bottom surface of the dust cup assembly T1 is in contact with a contact surface. In other words, other parts except the bottom surface of the dust cup assembly T1 are all located above the contact surface. In this way, since the relatively heavy airflow generation device 2 (especially the driving component such as the motor 211 in the airflow generation device 2) is not provided in the handle, the handle assembly T3 is lighter than the dust cup assembly T1. At this time, the dust cup assembly T1 can be independently supported, and the whole handheld vacuum cleaner T will not topple. In addition, since the handle assembly T3 is off the ground, an abrasion problem of the handle assembly T3 can be reduced, and the heat dissipation of the handle assembly T3 (for example, heat dissipation of the power supply 5 described below) can be improved to facilitate the cooling of the handheld vacuum cleaner T.

Optionally, referring to FIG. 22, the bottom surface of the handle assembly T3 is formed as a slope extending gradually upward, along the axis X-X of the suction channel S1 toward a direction away from the dust cup assembly T1 and close to the handle assembly T3. For example, referring to FIG. 22, the bottom surface of the handle assembly T3 is formed as an upwardly inclined slope in a front-to-rear direction. That is, a distance between the bottom surface of the handle assembly T3 and a placement surface gradually increases in the front-to-rear direction. Therefore, on the premise of ensuring that the whole handheld vacuum cleaner T does not topple, the abrasion problem of the handle assembly T3 can be further reduced, and the heat dissipation effect of the handle assembly T3 can be further improved.

Optionally, referring to FIG. 22, a height difference between the bottom surface F1 of the cup casing 1 and the bottom surface F2 of the handle assembly T3 is 0.5 mm to 1 mm, that is, the maximum vertical distance between the bottom surface F1 of the cup casing 1 and the bottom surface F2 of the handle assembly T3 can be 1 mm and the minimum vertical distance can be 0.5 mm. Therefore, on the premise of ensuring that the whole handheld vacuum cleaner T does not topple, the abrasion problem of the handle assembly T3 can be further reduced, and the heat dissipation effect of the handle assembly T3 can be further improved.

Optionally, referring to FIG. 22, the bottom surface F1 of the cup casing 1 is a flat surface. Therefore, the handheld vacuum cleaner T can be placed on the horizontal plane more stably, further avoiding the problem that the whole machine may topple, and the cup casing 1 is more convenient to process. Optionally, the bottom surface of the cup casing 1 includes a base surface and a plurality of support protrusions provided at the bottom of the base surface (this example is not shown in the drawings), thereby increasing a friction force of the bottom surface of the cup casing 1, enabling the handheld vacuum cleaner T to be more stably placed on the horizontal plane, and further avoiding the problem that the whole machine may topple. Optionally, the bottom surface of the cup casing 1 includes a base surface and an anti-skid layer (e.g., a rubber surface) provided at the bottom of the base surface (this example is not shown in the drawings), whereby the friction force of the bottom surface of the cup casing 1 can be increased, the handheld vacuum cleaner T can be placed on the horizontal plane more smoothly, the problem that the whole machine may topple can be further avoided, and the abrasion of the bottom surface of the cup casing 1 can be reduced.

In some embodiments of the present disclosure, referring to FIG. 22, the handle assembly T3 includes a handle 4 to be assembled with the cup casing 1 and a power supply 5 to supply power to the airflow generator 2. Optionally, the power supply 5 is located at a lower portion of the handle assembly T3, and a bottom surface of the power supply 5 constitutes at least a part of the bottom surface F2 of the handle assembly T3 and is higher than the bottom surface F1 of the cup casing 1. Therefore, when the handheld vacuum cleaner T is placed on the horizontal plane, the bottom surface of the power supply 5 can be off the ground, thereby not only reducing abrasion of the bottom surface of the power supply 5, but also improving a heat dissipation and cooling effect of the power supply 5, so as to prolong the service life of the whole handheld vacuum cleaner T.

In other words, the bottom surface of the power supply 5 can be spaced apart from the placement surface, thereby increasing a heat dissipation area of the power supply 5, improving the heat dissipation effect, and further shortening the cooling time of the power supply 5. Thus, when the user puts the handheld vacuum cleaner T on the placement face after use, the power supply 5 can be rapidly cooled, the abrasion of the bottom surface of the power supply 5 can be reduced, and liquids on the placement surface, such as water and the like, can be prevented from entering the power supply 5 to cause damage to the power supply 5, thereby prolonging the service life of the power supply 5, and enhancing the reliability of the handheld vacuum cleaner T.

Figure 23:
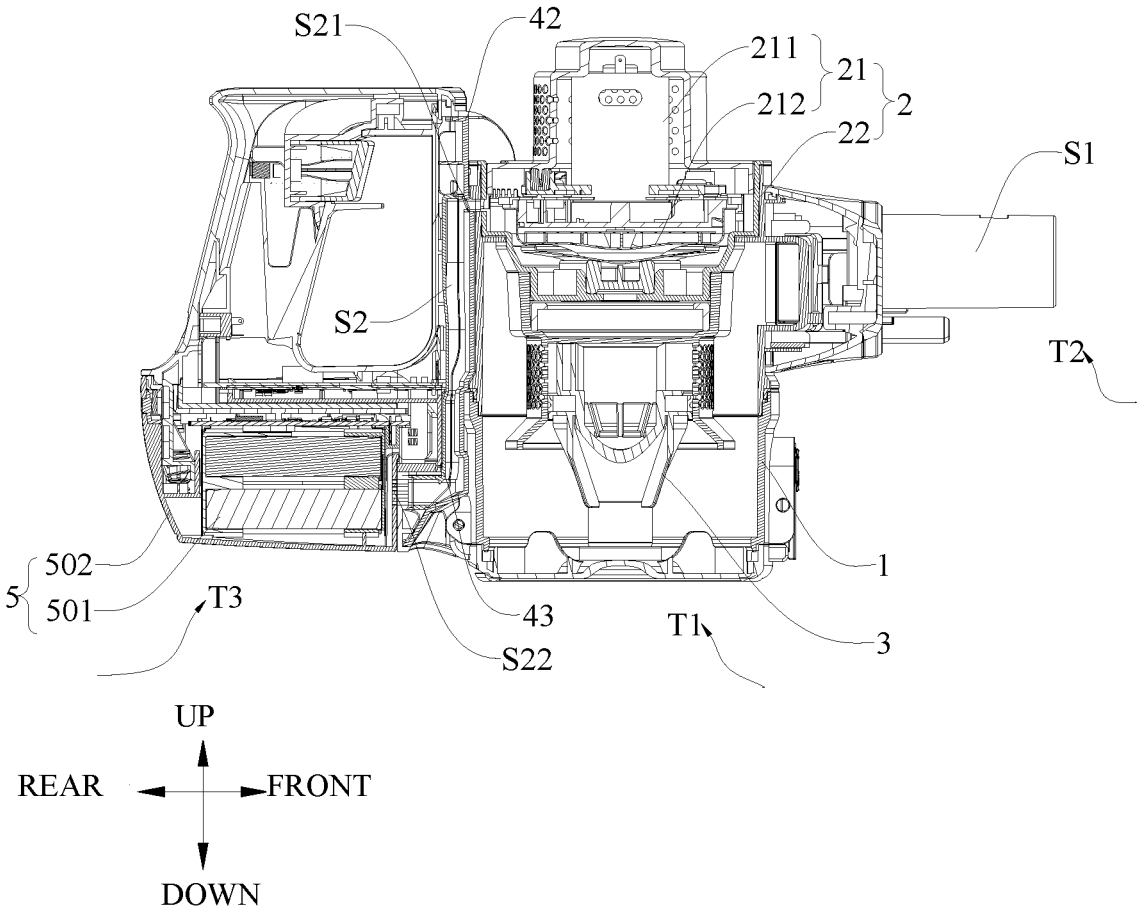
FIG. 23 is a partial sectional view illustrating a handheld vacuum cleaner according to an embodiment of the present disclosure.
Figure 24:
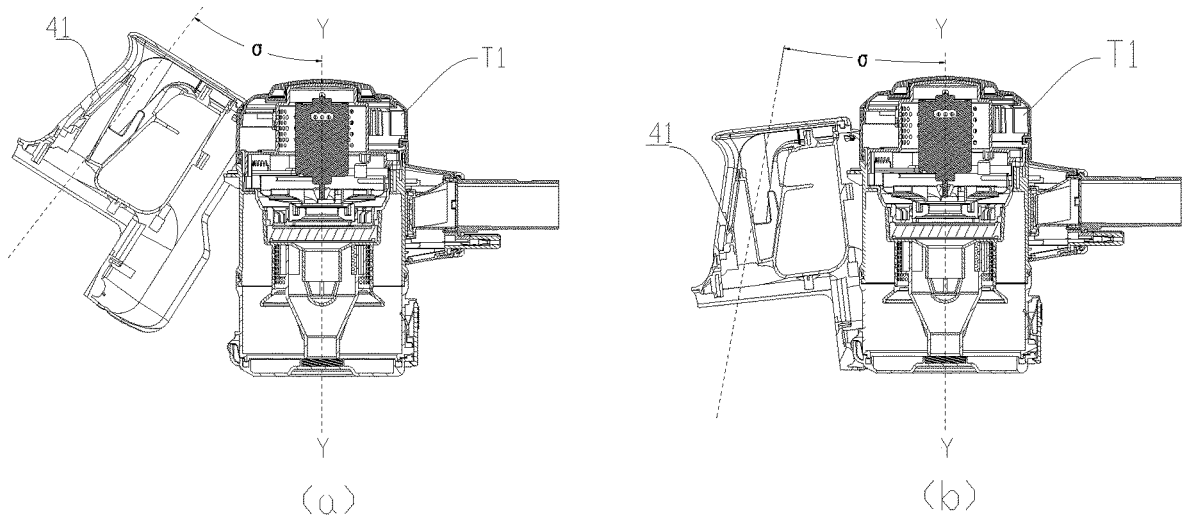
FIG. 24 is a partial schematic view illustrating a handheld vacuum cleaner according to some embodiments of the present disclosure.
Figure 25:
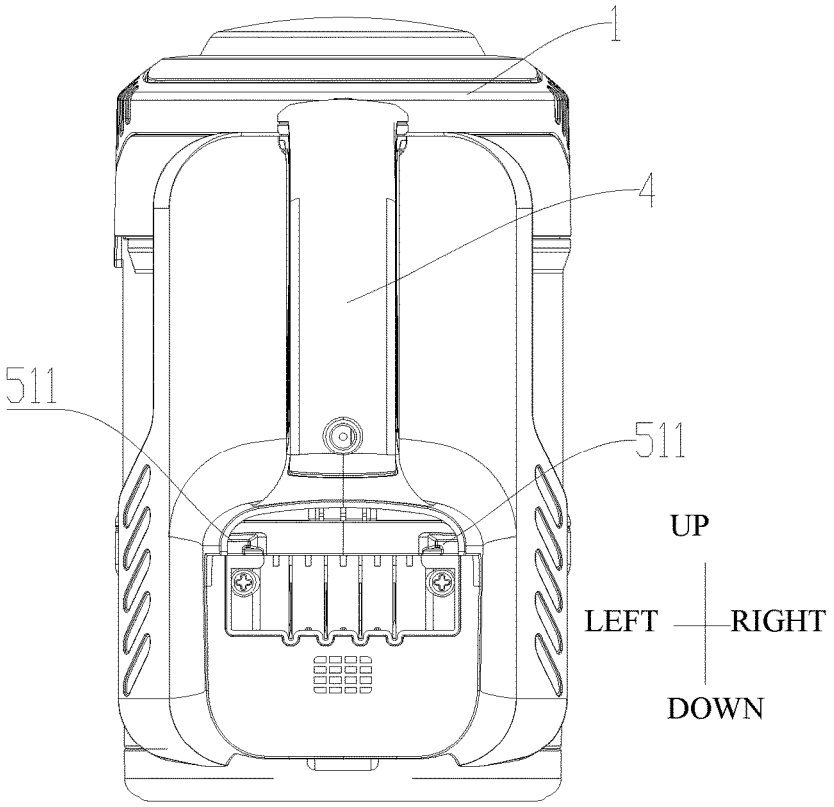
FIG. 25 is a rear view illustrating a handheld vacuum cleaner according to embodiments of the present disclosure, in which a power supply is not shown.

In some embodiments of the present disclosure, referring to FIGS. 22-24, the handle assembly T3 is mounted to the cup casing 1. The handle assembly T3 includes a gripping part 41 to be gripped, that is, the user lifts the handheld vacuum cleaner T by gripping the gripping part 41. For example, when the handle assembly T3 includes the handle 4 and the power supply 5 described above, the gripping part 41 can be formed on the handle 4. In one embodiment, an included angle $\sigma$ between a center line of the gripping part 41 and the central axis of the cup casing 1 satisfies: $0° \leq \sigma \leq 60°$. Therefore, on the premise of ensuring that the overall structure of the handheld vacuum cleaner T is small and compact, the user can hold the handheld vacuum cleaner T more easily and effortlessly.

In some embodiments of the present disclosure, referring to FIGS. 22-24, the handle assembly T3 and the cup casing 1 are connected through an adjustment mechanism so that the included angle $\sigma$ between the center line of the gripping part 41 and the central axis of the cup casing 1 can be adjusted. In other words, an inclination angle of the handle assembly T3 can be adjusted and changed according to needs, so as to adapt to different usage habits of different users and further conform to the humanized design. Here, it could be understood that the adjustment mechanism can be various, for example, a large and small gear meshing mechanism, in which the handle assembly T3 can be connected with a small gear, and the cup casing 1 can be provided with a large gear. When the small gear meshes and rolls with the large gear, the inclination angle of the handle assembly T3 relative to the cup casing 1 can be changed, thereby realizing the adjustment of the handle assembly T3.

In some embodiments of the present disclosure, referring to FIG. 22, when the handle assembly T3 includes the power supply 5 and the handle 4 described above, the power supply 5 can be connected to the handle 4. That is, the power supply 5 can be mounted to the handle 4, thereby simplifying the structure of the handle assembly T3. Further, the power supply 5 and the handle 4 can be detachably connected so that the power supply 5 can be removed from the handle 4, which makes it convenient for the user to carry out relevant operations on the power supply 5. For example, when the power supply 5 needs to be charged, repaired or replaced, the user can remove the power supply 5 from the handle 4 to carry out relevant operations.

In one embodiment, the handle 4 and the power supply 5 slidably cooperate through a guide assembly, the handle 4 and the power supply 5 are locked through a locking assembly 52 and the guide assembly, and the locking assembly 52 is unlocked through a quick release button 53. That is, the power supply 5 can move relative to the handle 4 in a sliding manner by providing the guide assembly; the relative positions of the power supply 5 and the handle 4 can be locked by providing the guide assembly and the locking assembly 52; and the locking assembly 52 can be unlocked by providing the quick release button 53, so that the power supply 5 can be detached from the handle 4. In one embodiment, both the guide assembly and the locking assembly 52 have a hidden structure. That is, when the power supply 5 and the handle 4 are assembled in place, the guide assembly and the locking assembly 52 are hidden inside the handheld vacuum cleaner T and are invisible to the user, thus improving the overall aesthetics of the handheld vacuum cleaner T and ensuring that the guide assembly and the locking assembly 52 will not be easily damaged.

For example, referring to FIGS. 22 and 25-29, the power supply 5 is disposed below the handle 4, and the power supply 5 cooperates with the handle 4 and can slide in the front-rear direction through the guide assembly. That is, by moving the power supply 5 forward in the front-rear direction, the power supply 5 can be conveniently mounted to the handle 4, and by moving the power supply 5 backward in the front-rear direction, the power supply 5 can be conveniently detached from the handle 4. Specifically, when the power supply 5 is to be assembled, the power supply 5 can be slid forward, so that the power supply 5 cooperates with the handle 4 through the guide assembly, and then the power supply 5 is locked with the handle 4 under the limiting action of the guide assembly and the locking action of the locking assembly 52, so that the position of the power supply 5 is stable, facilitating steady power supply of the power supply 5 to the airflow generation device 2. When the power supply 5 is to be removed, the quick release button 53 can be pressed to unlock the locking assembly 52, and then the power supply 5 can be removed from the handle 4 by sliding the power supply 5 backward through the guide assembly. Therefore, the structure is simple, and the disassembly and assembly is convenient.

Optionally, the quick release button 53 can be provided to the cup casing 1 and/or the handle 4. That is, the quick release button 53 may be provided only to the cup casing 1, or the quick release button 53 may be provided only to the handle 4, or the cup casing 1 and the handle 4 may be each provided with the quick release button 53, thereby realizing flexible arrangement of the quick release button 53 and facilitating user operation.

Optionally, the quick release button 53 is an electronic non-push button, that is, the quick release button 53 is connected with the locking assembly 52 through an electronic circuit. At this time, the user can trigger the locking assembly 52 to be unlocked by touching the quick release button 53, thereby improving the grade of the handheld vacuum cleaner T. Optionally, the quick release button 53 is a mechanical push button, that is, the quick release button 53 is connected with the locking assembly 52 through a mechanical structure. At this time, the user can trigger the locking assembly 52 to be unlocked by pressing the quick release button 53, thereby giving the user good tactile experience.

In some specific examples of the present disclosure, a guiding direction of the guide assembly, an unlocking direction of the locking assembly 52, and a pressing direction of the quick release button 53 are perpendicular to one another. That is, the guiding direction of the guide assembly is perpendicular to the unlocking direction of the locking assembly 52, the guiding direction of the guide assembly is perpendicular to the pressing direction of the quick release button 53, and the unlocking direction of the locking assembly 52 is perpendicular to the pressing direction of the quick release button 53. Therefore, the layout of various components is concise, mutual interference is not easy to occur, and the operation reliability is high.

The suction nozzle assembly T2, the dust cup assembly T1 and the handle assembly T3 are sequentially arranged from front to rear. The pressing direction is a left-right direction, one of the guiding direction and the unlocking direction is the front-rear direction, and the other one of the guiding direction and the unlocking direction is the up-down direction. For example, in the examples shown in FIGS. 22, 25, and 26, when the guiding direction is the front-rear direction, the unlocking direction is the up-down direction, and the pressing direction is the left-right direction. At this time, the power supply 5 can be assembled in the front-rear direction, and an unlocking operation can be performed in the left-right direction. For example, in some other examples (not shown in the drawings), when the guiding direction is the up-down direction, the unlocking direction is the front-rear direction, and the pressing direction is the left-right direction. At this time, the power supply 5 can be assembled in the up-down direction, and the unlocking operation can be performed in the front-rear direction. Therefore, it is convenient for the user to operate, and the power supply 5 is more convenient to disassemble and assemble.

Figure 26:
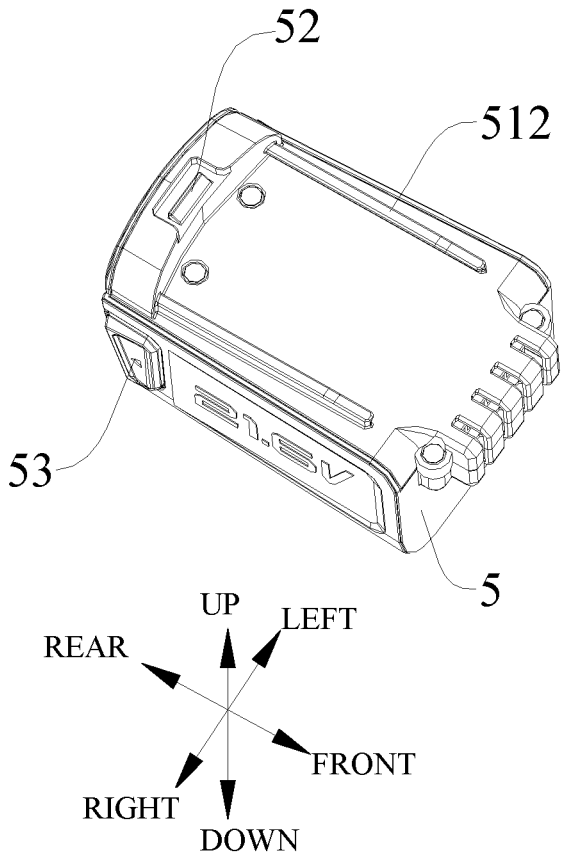
FIG. 26 is a perspective view illustrating a power supply according to embodiments of the present disclosure.
Figure 27:
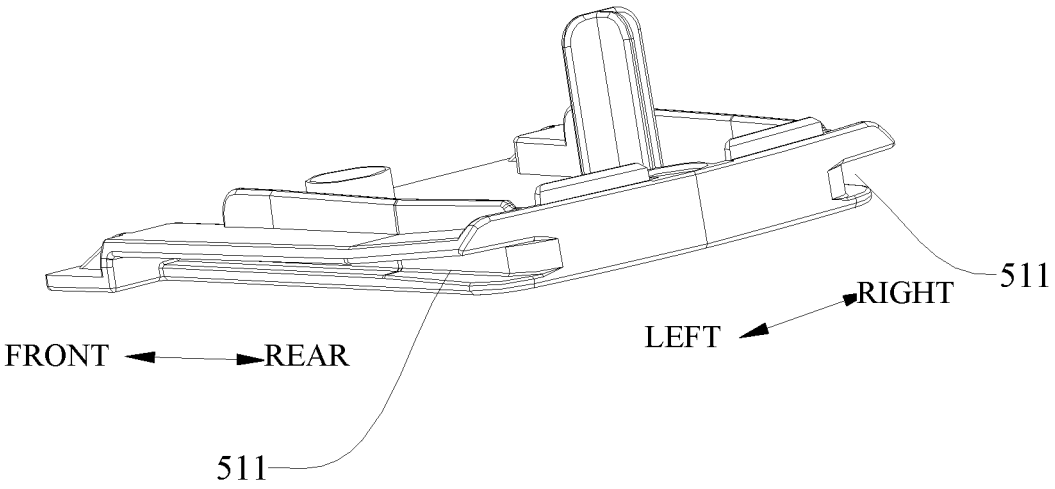
FIG. 27 is a schematic view illustrating a guide rail groove of a guide assembly according to embodiments of the present disclosure.
Figure 28:
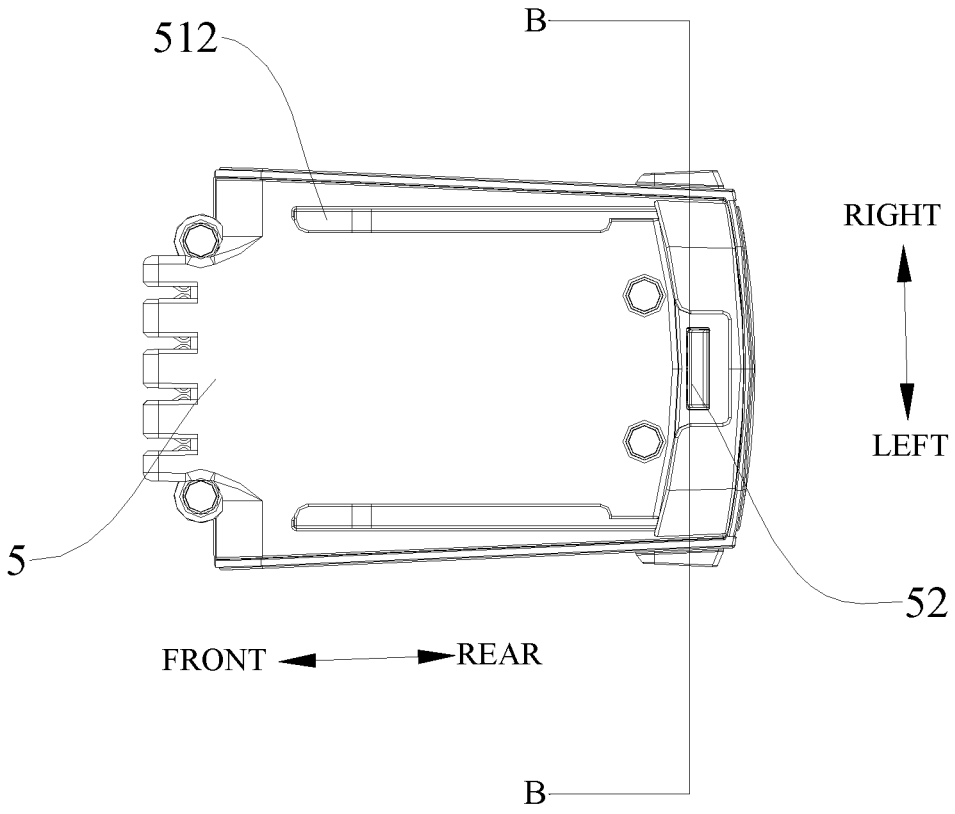
FIG. 28 is a top view illustrating a power supply according to embodiments of the present disclosure.

For example, in the example shown in FIG. 26, two quick release buttons 53 are provided, and the two quick release buttons 53 are exposed on the left and right side walls of the power supply 5 respectively. Thus, the user can unlock the locking assembly 52 by pressing the quick release buttons 53 toward each other with two fingers of one hand. Certainly, the present disclosure is not limited thereto, and only one quick release button 53 may be provided and arranged on the left side wall or the right side wall of the power supply 5.

In some embodiments of the present disclosure, the handheld vacuum cleaner T further includes a button reset elastic member 531, and the button reset elastic member 531 cooperates with the quick release button 53 to normally push the quick release button 53 to be reset, thereby simplifying the assembly steps, enabling the user to complete the assembly of the power supply 5 and the handle 4 more easily, and improving the connection reliability of the power supply 5 and the handle 4.

Figure 29:
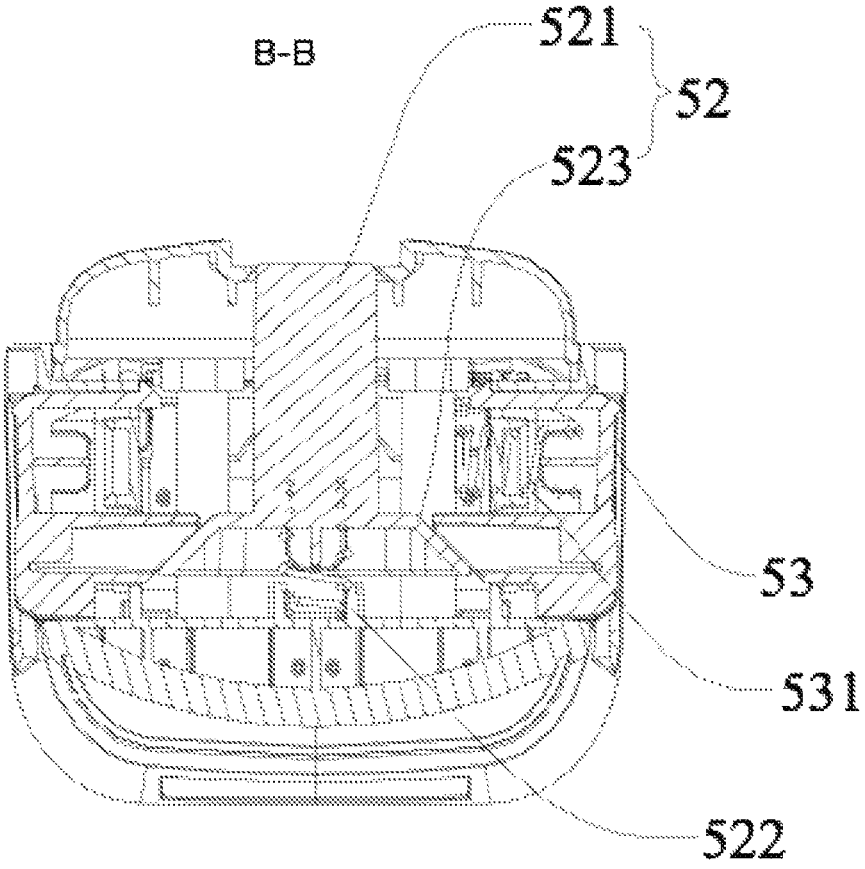
FIG. 29 is a sectional view taken along line B-B shown in FIG. 28.

As shown in FIG. 29, the quick release button 53 has a pressing surface suitable to be exposed to the outside of the power supply 5, to facilitate the user's pressing operation. The button reset elastic member 531 can be provided on a side of the quick release button 53 away from the pressing surface (i.e., a side close to a center of the power supply 5). When the quick release button 53 is pressed, the button reset elastic member 531 is in a compressed energy-storage state. When the quick release button 53 is released, the button reset elastic member 531 pushes the quick release button 53 outward to reset the quick release button 53, so as to facilitate the user's next pressing operation. Optionally, the button reset elastic member 531 may be a spring, but is not limited thereto.

In some embodiments of the present disclosure, the locking assembly 52 includes a latch and a latch reset elastic member 522. The latch is movably provided to the power supply 5 and is pushed by the latch reset elastic member 522 to normally lock the handle 4. The latch has a guide slope suitable to cooperate with the quick release button 53, and the guide slope is configured to drive the latch to unlock handle 4 when the quick release button 53 is pressed. Therefore, the locking assembly 52 has a simple structure, and is convenient and reliable to unlock and lock.

Specifically, referring to FIG. 29, the latch includes a latch body 521 and a guide portion 523. The guide portion 523 is formed at an end of the latch body 521 remote from the handle 4 (e.g., a lower end of the latch body 521 in FIG. 29), and extends obliquely from the above end of the latch body 521 toward a direction close to the quick release button 53, to form the guide slope. When the quick release button 53 is pressed, the quick release button 53 can slide relatively along the guide slope, so that the latch moves in a direction away from the handle 4 (e.g., downwards), thereby unlocking the handle 4. At this time, the latch reset elastic member 522 and the quick-release button reset elastic member 531 are both in a compressed energy-storage state. When the quick release button 53 is released, the quick release button 53 is reset under the push of the button reset elastic member 531, and the latch moves toward a direction close to the handle 4 (e.g., upwards) under the push of the latch reset elastic member 522 to lock the handle 4. Therefore, the locking and unlocking of the latch are realized conveniently, such that the power supply 5 can be reliably locked with the handle 4 and be detached conveniently, thereby improving the assembly reliability and the assembly efficiency of the power supply 5 and the handle 4.

In some embodiments of the present disclosure, the guide assembly includes a guide rail groove 511 formed in one of the handle 4 and the power supply 5, and a guide rail 512 provided on the other one of the handle 4 and the power supply 5 and slidably fitted with the guide rail groove 511. For example, referring to FIGS. 25 to 27, the guide rail groove 511 is formed in the handle 4, and the guide rail 512 is provided on the power supply 5. Specifically, two guide rail grooves 511 and two guide rails 512 are provided. The two guide rail grooves 511 can be formed in the lower end of the handle 4 and spaced apart in the left-right direction, the two guide rails 512 can be formed at the top of the power supply 5 and spaced apart in the left-right direction, and the guide rail grooves 511 and the guide rails 512 each extend in the front-rear direction. Therefore, the power supply 5 and the handle 4 can realize sliding fit by means of the built-in and hidden guide assembly.

In one embodiment, a lead-in end surface of the guide rail groove 511 is larger than a tail end surface of the guide rail groove 511, and/or an insertion end surface of the guide rail 512 is smaller than a tail end surface of the guide rail 512. As a result, the insertion difficulty of the guide rail groove 511 and the guide rail 512 can be reduced and the insertion efficiency of the guide rail groove 511 and the guide rail 512 can be improved, because the lead-in end surface of the guide rail groove 511 is larger or the insertion end surface of the guide rail 512 is smaller. In other words, it is convenient to insert the guide rail 512 into the guide rail groove 511, thereby realizing the assembly with one operation, reducing the assembly difficulty, and improving the assembly efficiency. For example, the guide rail groove 511 may be formed as a tapered groove, a flared groove, or the like.

Referring to FIGS. 25 to 29, an example of disassembly and assembly of the handle assembly T3 according to one specific embodiment of the present disclosure will be described below.

Two quick release buttons 53 are provided, and the two quick release buttons 53 are located on the left and right side walls of the power supply 5 respectively. The locking assembly 52 is formed on the power supply 5 and is movable in the up-down direction (i.e., the unlocking direction is the up-down direction). The guide rail 512 is formed on the top of the power supply 5 and extends in the front-rear direction, and the guide rail groove 511 is formed on the handle 4 and extends in the front-rear direction (i.e., the guiding direction is the front-rear direction). The lead-in end surface of the guide rail groove 511 is larger than the tail end surface of the guide rail groove 511.

When the power supply 5 is assembled, the power supply 5 can be slid forward, the guide rail 512 on the power supply 5 is inserted into the guide rail groove 511 on the handle 4, and the latch body 521 of the latch automatically locks the handle 4 under the action of the latch reset elastic member 522. When the power source 5 is disassembled, the quick release button 53 can be pressed first, the latch is moved downward through the cooperation of the quick release button 53 and the guide portion 523, and then the power supply 5 can be disassembled by sliding the power supply 5 backward. After the quick release button 53 is released, the quick release button 53 is rebounded and reset under the action of the button reset elastic member 531, and the latch is moved upwards and reset under the action of the latch elastic member 522.

In some optional embodiments of the present disclosure, the handheld vacuum cleaner T has a heat dissipation air duct S2 for guiding an airflow outside the handheld vacuum cleaner T to the power supply 5. Therefore, the power supply 5 can dissipate heat, cool down, and lower its temperature effectively, and the service life of the power supply 5 can be prolonged.

In other optional embodiments of the present disclosure, the handheld vacuum cleaner T has a heat dissipation air duct S2 for guiding an airflow in the cup casing 1 to the power supply 5. Therefore, the power supply 5 can dissipate heat, cool down, and lower its temperature effectively, and the service life of the power supply 5 can be prolonged. Optionally, an inlet of the heat dissipation air duct S2 is communicated to the downstream of the cyclone separation device 3, that is, the heat dissipation air duct S2 can lead the clean air separated and filtered by the cyclone separation device 3 to the power supply 5 for cooling, thereby preventing the untreated dusty air from polluting the power supply 5. Optionally, the inlet of the heat dissipation air duct S2 can also be communicated to the upstream of the cyclone separation device 3, in which case the airflow that is sucked into the cup casing 1 via the suction channel S1 and not treated by the cyclone separation device 3 can be led to the power supply 5 through the heat dissipation air duct S2. Since the temperature of the airflow is relatively low, the cooling effect on the power supply 5 is better.

For example, in some specific examples of the present disclosure, when the airflow generation device 2 is disposed downstream of the cyclone separation device 3, the inlet of the heat dissipation air duct S2 can be communicated to the airflow generation device 2, thereby facilitating the processing and implementation of the inlet of the heat dissipation air duct S2, and the airflow pressure here is relatively high, facilitating the air blowing to the power supply 5. For example, in an example shown in FIG. 23, the airflow generation device 2 is provided on an upper side of the cyclone separation device 3. The airflow entering from the suction channel S1 is first separated by the cyclone separation device 3 and then flows to the airflow generation device 2. When the airflow flows to the airflow generation device 2 or after the airflow flows into the airflow generation device 2, part of the airflow is led to the power supply 5 through the heat dissipation air duct S2.

Optionally, when the airflow generation device 2 includes the negative pressure unit 21 and the hood 22 disposed outside and covering the negative pressure unit 21, the inlet of the heat dissipation air duct S2 can penetrate the hood 22, thereby facilitating the processing of the inlet and resulting in a good suction effect of the heat dissipation air duct S2. Further, the negative pressure unit 21 includes the fan wheel 212 and the motor 211 connected to the fan wheel 212, and the inlet of the heat dissipation air duct S2 is disposed adjacent to an outlet of the fan wheel 212. Therefore, it is convenient to process the inlet of the heat dissipation air duct S2, and the airflow pressure here is relatively high, facilitating the air blowing to the power supply 5. Further, it can be avoided that an incoming airflow is sent into the heat dissipation air duct S2 after being heated by the motor 211, so that the airflow in the heat dissipation air duct S2 can be kept at a low temperature, thus improving the cooling effect of the airflow on the power supply 5.

In some embodiments of the present disclosure, referring to FIG. 22, an outlet of the heat dissipation duct S2 is communicated to the power supply 5. As a result, air can be supplied to the power supply 5 more directly, and the cooling efficiency of the power supply 5 can be improved to reduce the waste and energy consumption. Optionally, the power supply 5 includes a battery pack 501 (which may be, for example, an ordinary battery pack 501 or an accumulator pack 501) and a battery case 502 disposed outside and covering the battery pack 501, and the outlet of the heat dissipation air duct S2 penetrates the battery case 502. Therefore, the battery pack 501 can be protected by the battery case 502, and the airflow flowing out of the outlet of the heat dissipation air duct S2 can be directly blown to the battery pack 501, further improving the cooling effect on the power supply 5, facilitating the processing of the outlet, and resulting in a better and more direct air blowing effect.

In some embodiments of the present disclosure, the handle 4 includes a handle housing 42 assembled to the cup casing 1 and an inner partition plate 43 provided in the handle housing 42. At least one section of the heat dissipation air duct S2 is formed between the inner partition plate 43 and the handle housing 42. Therefore, the heat dissipation air duct S2 is convenient to process, and does not take up too much space, thereby ensuring a small overall size of the handheld vacuum cleaner T. Optionally, the inner partition plate 43 is detachably connected to the handle housing 42, and for example, the inner partition plate 43 can be connected with the handle housing 42 by a snap or the like. Therefore, the position of the inner partition plate 43 can be flexibly adjusted according to specifications and models of the handheld vacuum cleaner T, the position of the inlet S21 of the heat dissipation air duct S2 can be changed, and the heat dissipation air duct S2 can be cleaned by removing the inner partition plate 43 and the handle housing 42, so as to better prevent the dusty air from polluting the power supply 5.

In the description of the present disclosure, it is to be understood that, terms such as "central," "longitudinal," "lateral," "length," "width," "thickness," "above," "below," "front," "rear," "left," "right," "vertical," "horizontal," "top," "bottom," "inner," "outer," "clockwise," "counterclockwise," "axial," "radial," and "circumferential" refer to the orientation or location relationships as then described or as shown in the drawings under discussion. These terms are only for convenience and simplicity of description, rather than indicate or imply that the device or the element referred to must have a particular orientation, or be constructed or operated in a particular orientation, and hence these terms should not be understood as the limitation on the present disclosure.

In addition, terms such as "first" and "second" are used herein for purposes of description and are not intended to indicate or imply relative importance or significance. Thus, the feature defined with "first" and "second" may comprise one or more this feature. In the description of the present disclosure, the term "a plurality of" means two or more, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications or mutual interaction of two elements.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. The appearances of the above phrases in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments of the present disclosure have been illustrated and described, and changes, modifications, alternatives and variations can be made in the embodiments without departing from principles and purposes of the present disclosure, and the scope of the present disclosure is defined by claims and the like.

What is claimed is:

1. A handheld vacuum cleaner, comprising:

a dust cup assembly comprising:

a cup casing arranged vertically;

an airflow generation device; and a cyclone separation device, wherein the airflow generation device and the cyclone separation device being arranged in the cup casing, the airflow generation device being arranged above the cyclone separation device and located at a downstream side of the cyclone separation device, and an air vent being formed in a top of the cup casing;

a suction nozzle assembly mounted to the cup casing and defining a suction channel; and a handle assembly mounted to the cup casing and used to be held;

wherein an inner side of the air vent is provided with an air guide surface to adjust a blowing direction of the air vent, and an included angle a between an extension line of the air guide surface and a connection line between a central point of the air vent and a central point of a dust cup is projected onto a horizontal plane and satisfies: $10° \leq \alpha \leq 90°$;

wherein projected onto the horizontal plane, a width D between a front side wall of the air vent and a rear side wall of the air vent is larger than a width d between a rear side wall of an outer edge of the air guide surface and the rear side wall of the air vent, wherein the width d satisfies: 2 mm≤d≤6 mm.

2. The handheld vacuum cleaner according to claim 1, wherein the suction nozzle assembly is transversely mounted to the cup casing, and projected onto a vertical plane, a blowing direction of the air vent is inclined upward relative to an axial direction of the suction channel.

3. The handheld vacuum cleaner according to claim 1, wherein an included angle θ between an axial direction of the suction channel and a blowing direction of the air vent is projected onto a horizontal plane and satisfies: $20° \leq \theta \leq 120°$.

4. The handheld vacuum cleaner according to claim 1, wherein a plurality of air vents are provided and are each formed into an elongated shape extending along an up-down direction, and projected onto a horizontal plane, the plurality of the air vents are symmetrically distributed about an axis of the suction channel.

5. The handheld vacuum cleaner according to claim 1, wherein the airflow generation device comprises a motor and a fan wheel connected with a rotating shaft of the motor, the cup casing is cylindrical and has a central axis parallel to but not coincident with a rotation axis of the motor, and an axis of the suction channel intersects with and is perpendicular to the central axis of the cup casing.

6. The handheld vacuum cleaner according to claim 1, wherein the airflow generation device comprises a motor and a fan wheel connected with a rotating shaft of the motor, and an axis of the suction channel intersects with a rotation axis of the motor at an acute angle or an obtuse angle.

7. The handheld vacuum cleaner according to claim 6, wherein an acute angle y at which the axis of the suction channel intersects with the rotation axis of the motor satisfies: $20° \leq \gamma \leq 70°$.

8. The handheld vacuum cleaner according to claim 1, wherein the airflow generation device comprises a motor and a fan wheel connected with a rotating shaft of the motor, and an axis of the suction channel is parallel to or coincident with a rotation axis of the motor.

9. The handheld vacuum cleaner according to claim 1, wherein the airflow generation device comprises a negative pressure unit and a hood arranged outside and covering the negative pressure unit, an axis of the suction channel extends along a horizontal direction and is below a top end of the negative pressure unit, and a vertical distance L between the axis of the suction channel and the top end of the negative pressure unit satisfies $0.2\ H \leq L \leq 1.2\ H$, wherein H is a height of the negative pressure unit in a vertical direction.

10. The handheld vacuum cleaner according to claim 1, wherein an axis of the suction channel extends along a horizontal direction and is below a top end of the cup casing, and a vertical distance L between the axis of the suction channel and the top end of the cup casing satisfies $0.2\ S \leq L \leq 0.8\ S$, wherein S is a height of the cup casing in a vertical direction.

11. The handheld vacuum cleaner according to claim 1, wherein an upstream filter is provided between the airflow generation device and the cyclone separation device, and a downstream filter is provided on a downstream side of the airflow generation device.

12. The handheld vacuum cleaner according to claim 11, wherein the air vent is arranged opposite to the downstream filter.

13. The handheld vacuum cleaner according to claim 12, wherein the airflow generation device comprises a negative pressure unit and a hood arranged outside and covering the negative pressure unit, the hood is provided with a plurality of exhaust holes, the downstream filter is annular and sleeved over the hood to surround the exhaust holes, and the air vent is arranged around the downstream filter.

14. The handheld vacuum cleaner according to claim 13, wherein the cyclone separation device comprises a primary cyclone separator, a secondary cyclone separator arranged in the primary cyclone separator, and a filter cartridge arranged in the secondary cyclone separator, wherein an airflow enters between the cup casing and the primary cyclone separator tangentially through the suction channel to undergo first cyclone separation, then enters between the secondary cyclone separator and the filter cartridge through the primary cyclone separator and the secondary cyclone separator to undergo second cyclone separation, then flows to the airflow generation device through the filter cartridge and the upstream filter, and finally is discharged out of the cup casing through the downstream filter device and the air vent.

15. The handheld vacuum cleaner according to claim 1, wherein the handle assembly comprises a handle to be assembled with a cup casing, and a power supply connected with the handle and used to supply power to the airflow generation device, wherein the handheld vacuum cleaner is internally provided with a heat dissipation air duct configured to guide an airflow in the cup casing to the power supply.

16. The handheld vacuum cleaner according to claim 1, wherein a dust retaining rib is provided to an inner wall surface of the cup casing.

* * * * *